US009116453B2

(12) United States Patent
Kato et al.

(10) Patent No.: US 9,116,453 B2
(45) Date of Patent: Aug. 25, 2015

(54) IMAGE FORMING APPARATUS

(71) Applicants: Shigetaka Kato, Shinshiro (JP); Katsufumi Suzuki, Okazaki (JP); Natsuyo Higashi, Toyokawa (JP); Hirotada Seki, Toyokawa (JP)

(72) Inventors: Shigetaka Kato, Shinshiro (JP); Katsufumi Suzuki, Okazaki (JP); Natsuyo Higashi, Toyokawa (JP); Hirotada Seki, Toyokawa (JP)

(73) Assignee: Konica Minolta Business Technologies, Inc., Chiyoda-ku, Tokyo (JP)

( * ) Notice: Subject to any disclaimer, the term of this patent is extended or adjusted under 35 U.S.C. 154(b) by 159 days.

(21) Appl. No.: 13/845,881

(22) Filed: Mar. 18, 2013

(65) Prior Publication Data

US 2013/0259496 A1 Oct. 3, 2013

(30) Foreign Application Priority Data

Apr. 2, 2012 (JP) ..... 2012-083946

(51) Int. Cl.
*G03G 15/00* (2006.01)
*G03G 15/01* (2006.01)

(52) U.S. Cl.
CPC ..... *G03G 15/0126* (2013.01); *G03G 15/5058* (2013.01); *G03G 15/0189* (2013.01); *G03G 2215/0158* (2013.01)

(58) Field of Classification Search
CPC ..... G03G 2215/0158; G03G 15/0126; G03G 15/0189; G03G 15/5054; G03G 15/5058
USPC ..... 399/40, 49
See application file for complete search history.

(56) References Cited

U.S. PATENT DOCUMENTS

| | | | | |
|---|---|---|---|---|
| 8,717,639 | B2 * | 5/2014 | Arakawa | 358/488 |
| 2007/0059053 | A1 * | 3/2007 | Namba | 399/301 |
| 2007/0134014 | A1 * | 6/2007 | Kato et al. | 399/49 |
| 2011/0317175 | A1 * | 12/2011 | Murayama et al. | 358/1.2 |

FOREIGN PATENT DOCUMENTS

| | | | |
|---|---|---|---|
| JP | 2001-312116 | A | 11/2001 |
| JP | 2003-66677 | A | 3/2003 |
| JP | 2008-139592 | A | 6/2008 |
| JP | 2011-170165 | A | 9/2011 |
| JP | 2012-27138 | A | 2/2012 |

OTHER PUBLICATIONS

Office Action (Notice of Reasons for Refusal) issued on Mar. 4, 2014, by the Japanese Patent Office in corresponding Japanese Patent Application No. 2012-083946, and an English Translation of the Office Action (6 pages).

* cited by examiner

*Primary Examiner* — David Gray
*Assistant Examiner* — Andrew V Do
(74) *Attorney, Agent, or Firm* — Buchanan Ingersoll & Rooney PC

(57) ABSTRACT

An image forming apparatus calculates a positional deviation in the main and sub-scanning directions for each color by forming registration patterns in two arrays along a sub-scanning direction on an image carrier. Each registration pattern in one array is paired with an identical registration pattern in the other array. A first sensor has: a light-emitting element irradiating one registration pattern in a pair; a photodetector for regular reflection light; and a photodetector for diffuse reflection light. A second sensor has: a light-emitting element irradiating the other one in the pair; and a photodetector for regular reflection light. The relative positions of a pair of registration patters calculated using the respective sensors are corrected so as to reduce the positional deviation between the calculated positions by the amount of offset deviation estimated occur between positions detected by the respective sensors when the registration patterns are without positional deviation.

8 Claims, 11 Drawing Sheets

IMAGE FORMING APPARATUS

This application is based on application No. 2012-083946 filed in Japan, the contents of which are hereby incorporated by reference.

BACKGROUND OF THE INVENTION (1) Field of the Invention

The present invention relates to image forming apparatuses, such as printers and copiers. In particular, the present invention relates to registration correction techniques according which registration patterns having a predetermined shape are formed on the surface of an image carrier of an image forming apparatus, the amount of the position deviation of each registration pattern is calculated, and the timings for image forming processes such as exposure timing are adjusted according to the results of calculation.

(2) Description of the Related Art

Image forming apparatuses capable of color printing forms a color image generally by overlaying mono-color images in yellow (Y), magenta (M), cyan (C), and black (K) on an image carrier, such as a photosensitive drum or an intermediate transfer belt. Naturally, mono-color images overlaid with a positional deviation relative to one another results in color registration error.

In view of this, such an image forming apparatus performs registration correction in which the amount of positional deviation is calculated for each mono-color image at a predetermined time (at the time of power-on, for example) and the timings for image forming processes such as exposure timing are adjusted according to the results of calculation. Specifically, a plurality of toner image patterns having a predetermined shape are formed one for each color on the image-carrying surface of an image carrier. Each toner image pattern is used to detect the amount of positional deviation of the corresponding color and hereinafter referred to as "registration pattern". Subsequently, the position of each registration pattern is detected with an optical sensor (such as a reflection-type toner density sensor). Based on the result of the detection, the amount of positional deviation in the registration pattern in each color is calculated, and the registration correction is carried out by adjusting the timings for image forming processes such as exposure timing.

One method having been used for detecting the position of a registration pattern employs a reflection-type toner density sensor provided with a light-emitting element and a regular reflection photodetector. The toner density sensor irradiates the registration pattern with light emitted from the light-emitting element and detects regular reflection light from the registration pattern (see Patent Literature 1: Japanese patent application publication No. 2001-312116). Another method employs a reflection-type toner density sensor provided with a light-emitting element and a diffuse reflection photodetector to detect diffused reflection light with the diffuse reflection photodetector.

Since the amount of diffuse reflection light is smaller than that of regular reflection light, the latter method compares unfavorably to the former method in detection accuracy. Also, in order to increase the amount of diffuse reflection light to make the latter method comparable to the former method in accuracy, a large light source needs to be employed as the light-emitting element and therefore the manufacturing cost needs to be increased as well. In addition, the latter method is susceptible to various factors, such as the surface condition and color of the image carrier, and therefore has restrictions on detection conditions.

On the other hand, the former method does not require a large light source as the light-emitting element and ensures that an amount of regular reflection light sufficient to detect the position of a registration pattern is obtained by irradiating the registration pattern with a small amount of light. In addition, the former method is not affected by to such factors as the surface condition and color of the image carrier, and therefore has fewer constrains on detection conditions. In view of the above, the former method is preferable as a method for position detection of the registration pattern. As one example, Patent Literature 1 mentioned above discloses a technique for detecting the position of a registration pattern to carry out registration correction using the former method.

According to the technique, the positional deviation of the registration pattern is accurately calculated and the timings for image forming processes such as exposure timing are appropriately corrected based on the results of calculation, which ensures that a color image formed on the image carrier is without color registration error.

In many cases, a reflection-type toner density sensor used for the position detection of a registration pattern is also used for the toner density measurement of patch toner images (of the respective colors of Y, M, C, and K) to adjust image density in image stabilization control. FIG. 11A shows an output characteristic curve plotted between the output voltage and the toner density of a K-color patch toner image measured by a reflection-type toner density sensor that detects regular reflection light.

As shown in the figure, in the case of the color K, the toner image density measured by the reflection-type toner density sensor which detects regular reflection light exhibits such a curve that the sensor output voltage decreases as the toner density increases from the low density to the high density. It means that the reflection-type toner density sensor that detects regular reflection light is usable also for the toner density measurement of a K-color patch toner image.

FIG. 11B shows an output characteristic curve plotted between the output voltage and the toner density of a color patch toner image such as Y, M, or C measured by a reflection-type toner density sensor that detects regular reflection light. In the figure, the reference sign P denotes the output characteristic curve obtained by measurement by the reflection-type toner density sensor which detects regular reflection light, whereas the reference sign Q denotes the output characteristic curve obtained by measurement by the reflection-type toner density sensor that detects diffuse reflection light.

As seen from the output characteristic curve P, in the low-density range, the output voltage of the sensor detecting regular reflection light decreases as the toner density increases. Then, as the toner density increases, the output voltage of the sensor detecting diffuse reflection light gradually increases as shown in the output characteristic curve Q. Being influenced by this increase, in the high-density range, the output characteristic curve P gradually increases rater than decreasing, with the increase of the toner density (see a portion encircled in a dotted line in FIG. 11B). It means that in the case of colors such as Y, M, and C, other than K (colors other than K is hereinafter simply referred to as a "color"), the reflection-type toner density sensor that detects regular reflection light is unable to accurately detect the toner density in a high-density range. Therefore, in view of measurement accuracy, it is not preferable to use a toner density sensor for measuring regular reflection light also for the toner density measurement of a color patch toner image.

One attempt to eliminate the influence of diffuse reflection light is to use a reflection-type toner density sensor having a light-emitting element and two photodetectors, one for regular reflection light and the other for diffuse reflection light. By detecting the difference between regular reflection light and diffuse reflection light, the output characteristic curve as shown in FIG. 11C is obtained in which the sensor output voltage decreases as the toner density increases all the way to the high-density range.

FIG. 11C shows output characteristic curves each plotted between the output voltage and the toner density of a color (i.e., Y, M, or C) patch toner image measured by (i) a reflection-type toner density sensor that detects the difference between regular reflection light and diffuse reflection light, (ii) a reflection-type toner density sensor that detects regular reflection light, and (iii) a reflection-type toner density sensor that detects diffuse reflection light.

In the figure, the reference sign P' denotes the output characteristic curve of the reflection-type toner density sensor that detects regular reflection light, the reference sign Q' denotes the output characteristic curve of the reflection-type toner density sensor that detects diffuse reflection light, and the reference sign R denotes the output characteristic curve of the reflection-type toner density sensor that detects the difference between regular reflection light and diffuse reflection light.

As in the output characteristic curve R, by detecting the difference between regular reflection light and diffuse reflection light, the resulting output characteristic curve shows that the sensor output voltage decreases as the toner density increases all the way to the high-density region.

The above observation means that the reflection-type toner density sensor that detects the difference between regular reflection light and diffuse reflection light is usable also for the toner density measurement of a patch toner image in color, such as Y, M, or C.

In one example, Patent Literature 2 (Japanese Patent Application No. 2008-139592) discloses a reflection-type toner density sensor provided with a light-emitting element as well as both a photodetector for regular reflection light and a photodetector for diffuse reflection light. This sensor detects components of both regular reflection light and diffuse reflection light and outputs the difference between the respective components. Patent Literature 2 also discloses the use of the reflection-type toner density sensor for both the toner image measurement of a color patch toner image and the misregistration detection.

Unfortunately, however, the use of reflection-type toner density sensor having two photodetectors for the two purposes as in the conventional technique described above has the following setback. That is, since at least two reflection-type toner density sensors are required for detecting the position of a registration pattern, the number of photodetectors needs to be increased by two as compared with a reflection-type toner density sensor having one photodetector (i.e., a reflection-type toner density sensor having a photodetector for regular reflection light only). This causes increase of the manufacturing cost.

SUMMARY OF THE INVENTION

In order to address the above, an image forming apparatus according to one embodiment of the present invention calculates an amount of positional deviation for each of a plurality of colors by: forming registration patterns in two arrays along a sub-scanning direction on an image carrying surface of an image carrier by a plurality of image creation units that are configured to create toner images in the respective colors, each array including for each color a registration pattern for detecting a positional deviation in the main scanning direction and a different registration pattern for detecting a positional deviation in the sub-scanning direction, each registration pattern in one of the arrays being paired with an identical registration pattern in the other array, the two arrays being arranged such that the registration patterns in each pair are side by side along the main scanning direction; irradiating each pair of registration patterns with light; and detecting light reflected from each pair of registration patterns. Further, the image forming apparatus includes a first toner density sensor, a second toner density sensor, a calculating unit, and a storage unit. The first toner density sensor includes: a light-emitting element configured to emit light to irradiate one of the registration patterns in each pair; a regular reflection photodetector configured to detect regular reflection light from the one registration pattern in the pair; and a diffuse reflection photodetector configured to detect diffuse reflection light from the one registration pattern in the pair. In addition, the first toner density sensor is configured to output a difference between detection signals of the reflection light detected by the respective photodetectors. The second toner density sensor includes: a light-emitting element configured to emit light to irradiate the other one of the registration patterns in the pair; and a single photo detector that is a regular reflection photodetector configured to detect regular reflection light from the other registration pattern in the pair. In addition, the second toner density sensor is configured to output a detection signal of the regular reflection light detected by the regular reflection photodetector. The calculating unit is configured to calculate: a position of the one of the registration patterns in the pair by using the difference between the respective detection signals output by the first toner density sensor; a position of the other registration pattern in the pair by using the detection signal of the regular reflection light output by the second toner density sensor; and a positional deviation for each registration pattern in the pair based on the respective positions calculated. The storage unit stores an index value indicating an amount of offset deviation estimated to occur between respective positions calculated for the registration patterns in the pair based on the respective detection signals output by the first toner density sensor and the second toner density sensor when the registration patterns in the pair are formed without any positional deviation. The calculating unit corrects a relative positional relation between the respective positions calculated for the registration patterns in the pair in a manner that an amount of positional deviation between the respective positions is reduced by the index value.

BRIEF DESCRIPTION OF THE DRAWINGS

These and other objects, advantages and features of the invention will become apparent from the following description thereof taken in conjunction with the accompanying drawings those illustrate a specific embodiments of the invention.

In the drawings.

DESCRIPTION OF THE PREFERRED EMBODIMENTS

The following describes an embodiment of an image forming apparatus according to one aspect of the present invention, by way of an example directed to a tandem-type digital color printer (hereinafter, simply "printer").

1. Structure of Printer

Figure 1:
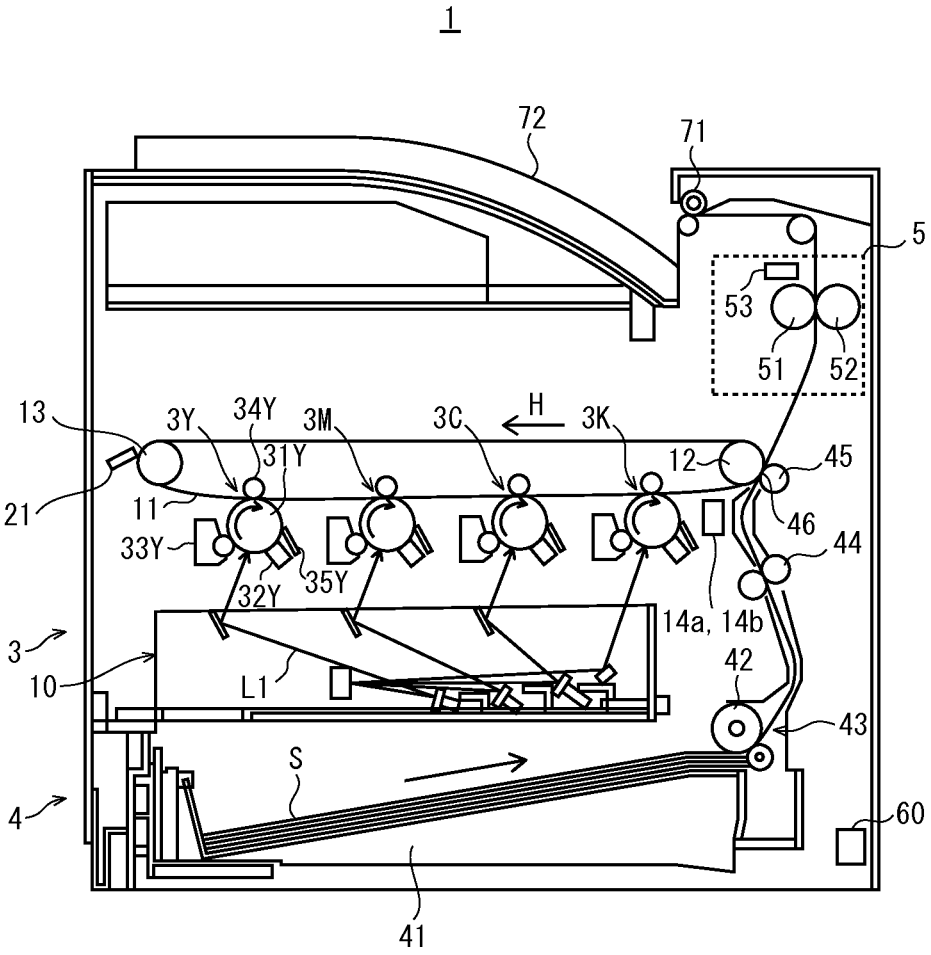
FIG. 1 shows the structure of a printer 1.

First, the following describes the structure of a printer 1 according to the present embodiment. FIG. 1 is a view showing the structure of the printer 1. As shown in the figure, the printer 1 includes an image processor 3, a paper feeder 4, a fixing device 5, and a controller 60.

The printer 1 is connected to a network (LAN, for example) and receives a print instruction from an external terminal (not illustrated) or via an operation panel. Upon receipt of a print instruction, the printer 1 executes a print process onto a recording sheet according to the print instruction by forming toner images of respective colors of yellow, magenta, cyan, and black and then forming a full-color image by overlaying the toner images.

In the following description, yellow, magenta, cyan, and black are denoted by the letters Y, M, C, and K, respectively, and component units relating to these colors are each denoted by a reference sign to which a corresponding one of the letters Y, M, C, and K is attached. The image processer 3 includes image creating units 3Y, 3M, 3C, and 3K, an exposure unit 10, an intermediate transfer belt 11, and a second transfer roller 45. At a location downstream from the image creating unit 3K in the direction of the rotation of the intermediate transfer belt 11 (i.e., the direction indicated by an arrow H), reflection-type toner density sensors 14*a* and 14*b*, which will be described later, are disposed on opposite sides of the intermediate transfer belt 11 in the width direction. Note that the reflection-type toner density sensor 14*a* is for detection of black toner density (hereinafter, simply "black toner density sensor") and the reflection-type toner density sensor is for toner densities of colors other than black (hereinafter, simply "color toner density sensor").

The image creating units 3Y, 3M, 3C, and 3K are all substantially identical in structure. Therefore, the following mainly describes the structure of the image creating unit 3Y. The image creating unit 3Y includes a photosensitive drum 31Y and also includes a charger 32Y, a developer 33Y, a first transfer roller 34Y, and a cleaner 35Y, which are disposed about the photosensitive drum 31Y. The cleaner 35Y is provided for cleaning the image carrying surface of the photosensitive drum 31Y. The image creating unit 3Y forms a yellow toner image on the image carrying surface of the photosensitive drum 31Y.

The developer 33Y is disposed to face the image carrying surface of the photosensitive drum 31Y and carries charged toner to the image carrying surface. The intermediate transfer belt 11 is an endless belt wound around a drive roller 12 and a passive roller 13 in a taut condition to driven to rotate in the direction indicated by the arrow "C". In addition, a cleaner 21 is disposed in the vicinity of the passive roller 13 to remove residual toner from the image carrying surface of the intermediate transfer belt 11.

The exposure unit 10 is provided with light-emitting elements such as laser diodes. According to drive signals from the controller 60, the exposure unit 10 emits laser beams for forming toner images in the respective colors of Y, M, C, and K to scan the respective image carrying surfaces of the photosensitive drums in the image creating units 3Y, 3M, 3C, and 3K. As a result of the scanning with the laser beam, an electrostatic latent image is formed on the image carrying surface of the photosensitive drum 31Y having been charged by the charger 32Y. In the similar manner, an electrostatic latent image is formed also on the image carrying surface of each of the photosensitive drums 3M, 3C, and 3K.

The electrostatic latent images formed on the image carrying surface of each photosensitive drum is developed into a toner image of a corresponding color by the developer in a corresponding one of the image creating units 3Y, 3M, and 3C. In the process of first transfer, the tonner images thus formed are sequentially transferred by the first transfer rollers of the respective image creating units 3Y, 3M, 3C, and 3K (in FIG. 1, the reference sign 34Y is attached only to the first transfer roller of the image creating unit 3Y and the other first transfer rollers are not denoted by reference signs) to the image carrying surface of the intermediate transfer belt 11, wherein the toner images are transferred one by one at different timings so that the toner images are overlaid at the same position of the image carrying surface of the intermediate transfer belt 11. Then, in the process of second transfer, the toner images overlaid on the image carrying surface of the intermediate transfer belt 11 are transferred to a recording sheet all at once by the action of electrostatic force imposed by the second transfer roller 45. The recording sheet having the toner images transferred in the process of second transfer is further transported to the fixing device 5 where heat and pressure is applied to fix the unfixed toner images onto the recording sheet, and the recording sheet is ejected by an ejection roller 71 to a paper output tray 72.

The paper feeder 4 is provided with a paper feed cassette 41 for storing recording sheets (denoted by the reference sign S in FIG. 1), a feeding roller 42 for feeding recording sheets one by one from the paper feed cassette 41 to a document transport path 43, and a pair of timing rollers 44 for adjusting the timing for feeding the recording sheet to a second transfer position 46. Note that the number of paper feed cassettes is not limited to one and there may be more than one paper feed cassettes.

For example, recording sheets may be sheets of paper in differing size and/or thickness (regular paper, thick paper) and film sheets such as OHP sheets. When a plurality of paper feed cassette are provided, recording sheets may be separately stored in the paper feed cassettes according to the size, thickness, or material.

Each roller, including the feeding roller 42 and timing rollers 44, is driven to rotate by a motor (not illustrated) via a power transmission mechanism (not illustrated) such as gears and a belt. One example of the motor is a stepping motor whose rotation speed is controllable with high precision.

The recording sheet is transported from the paper feeder 4 to the second transfer position 46 at a timing that corresponds to the timing when the toner images overlaid on the image carrying surface of the intermediate transfer belt 11 are transported to the second transfer position 46. Then, by the action of the second transfer roller 45, the toner images overlaid on the image carrying surface of the intermediate transfer belt 11 are transferred to the recording sheet all at once in the process of the second transfer.

The fixing device 5 includes a heating roller 51, a pressing roller 52 pressed against the heating roller 51 to form a fixing nip between the rollers, and a temperature sensor 53 disposed in the vicinity of the heating roller 51 to measure the surface temperature of the outer peripheral surface of the heating roller 51.

The heating roller 51 has a heater (not illustrated) disposed in its hollow interior. By the controller 60 switching on and off the heater, the surface temperature of the heating roller is controlled at a predetermined temperature. Note the heating method employed by the fixing device 5 is not limited to that using heat roller. Alternatively, for example, heating by electromagnetic induction or by a resistive heating element may be applicable. The temperature sensor 53 is a non-contact temperature sensor, and a thermopile, non-contact thermister, NC sensor or the like is usable as the temperature sensor 53.

2. Structure of Controller

Figure 2:
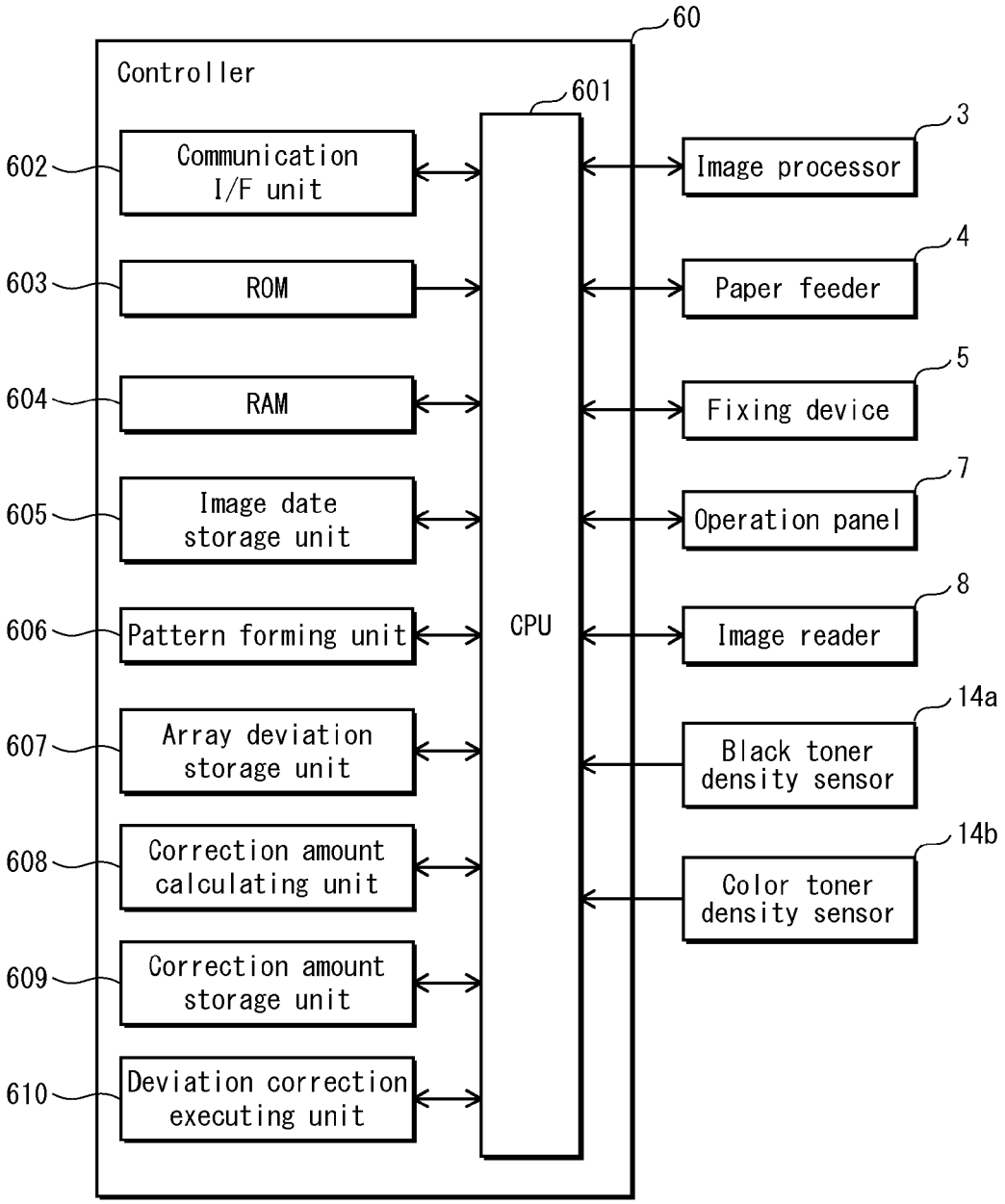
FIG. 2 shows the structure of a controller 60 and major component units controlled by the controller 60.

FIG. 2 shows the structure of the controller 60 and major component units controlled by the controller 60. The controller 60 is so-called a computer and includes, as shown in the figure, a CPU (Central Processing Unit) 601, a communication interface (I/F) unit 602, ROM (Read Only Memory) 603, RAM (Random Access Memory) 604, an image data storage unit 605, a pattern forming unit 606, an array deviation storage unit 607, a correction amount calculating unit 608, a correction amount storage unit 609, and a deviation correction executing unit 610.

The communication I/F unit 602 is an interface for establishing connection with LAN, such as a LAN card or LAN board. The ROM 603 stores various programs including a program for controlling the image processor 3, the paper feeder 4, the fixing device 5, the operation panel 7, the image reader unit 8, the black toner density sensor 14*a*, the color toner density sensor 14*b*, and other component units, and a program for carrying out the process of calculating positional deviation in the main scanning direction and the process of calculating positional deviation in the sub-scanning direction, which will be described later.

The RAM 604 is used as a work area by the CPU 601 at the time of program execution. The image data storage unit 605 stores image date for printing as received via the communication I/F unit 602 or the image reader unit 8. The pattern forming unit 606 reads pattern images stored in advance in the ROM 602 and forms toner image patterns in the predetermined shapes for detecting the positional deviation of each of Y, M, and C on the image carrying surface of the intermediate transfer belt 11. Note that each of such a tonner image pattern is hereinafter referred to as a "registration pattern".

Figure 3:
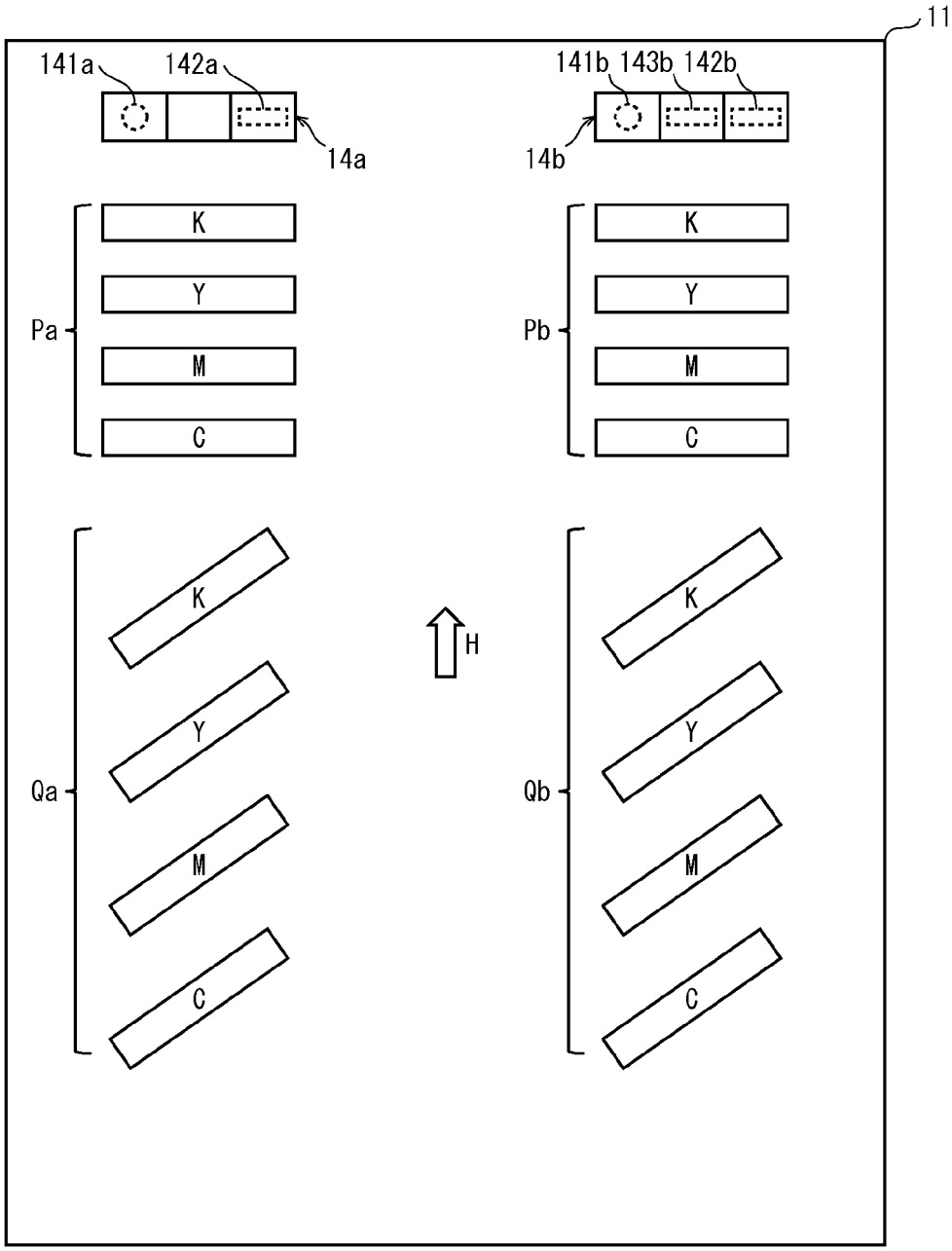
FIG. 3 shows one specific example of registration patterns formed by a pattern forming unit 606 on the image carrying surface of an intermediate transfer belt 11.

FIG. 3 shows one specific example of registration patterns formed by the pattern forming unit 606 on the image carrying surface of the intermediate transfer belt 11. As shown in the figure, the registration patterns are formed in two arrays along the sub-scanning direction on the image carrying surface of the intermediate transfer belt 11. Each array includes the registration patterns of the respective colors of K, Y, M, and C (hereinafter, registration patterns of the respective colors may be simply denoted as "registration patterns K, Y, M and C") in a manner that each registration pattern in one of the arrays is paired with an identical registration pattern of the same color in the other array and that the registration patterns in each pair are arranged side by side along the main scanning direction. Note that the sub-scanning direction refers to the rotation direction of the image carrying surface (i.e., the direction indicated by the open arrow H in the figure), whereas the main scanning direction refers to the direction perpendicular to the rotation direction.

In addition, the reference signs Pa and Pb shown in the figure each denote an array of registration patterns used to detect the positional deviation in the sub-scanning direction for each color (each of Y, M, and C) other than the reference color (K). The registration patterns in each array include the registration patterns of the respective colors (each of K, Y, M, and C) including the reference color and are hereinafter referred to as "sub-scanning registration detecting patterns".

In addition, the reference signs Qa and Qb shown in the figure each denote an array of registration patterns used to detect the positional deviation in the main scanning direction for each color (each of Y, M, and C) other than the reference color (K). The registration patterns in each array include the registration patterns of the respective colors (each of K, Y, M, and C) including the reference color (K) and are hereinafter referred to as "main scanning registration detecting patterns". In this example, each sub-scanning registration detecting pattern is formed so that it elongates along the main scanning direction, whereas each main scanning registration detecting pattern is formed so that it elongates along a direction inclined at 45° to the main scanning direction.

In addition, the reference sign 14*a* in the figure denotes the black toner density sensor, whereas the reference sign 14*b* denotes the color toner density sensor. The respective toner density sensors are disposed on the opposite sides of the intermediate transfer belt 11 in the width direction so as to face the image carrying surface of the intermediate transfer belt 11.

The black toner density sensor 14*a* detects one in a pair of registration patterns of the same color arranged side by side along the main scanning direction on the image carrying surface intermediate transfer belt 11, whereas the color toner density sensor 14*b* detects the other registration pattern in the pair.

The black toner density sensor 14*a* is provided with an LED light-emitting element (hereinafter, simply "LED element") 141*a* and a photodiode serving as a photodetector 142*a*. The black toner density sensor 14*a* irradiates a registration pattern with light emitted by the LED element 141*a*, receives regular reflection light from the registration pattern with the photodetector 142*a*, and outputs to the controller 60 a voltage signal corresponding to the amount of regular reflection light received.

The black toner density sensor 14*a* is also used to detect the toner density of each of a plurality of patch toner images formed in K color with different toner densities for the purpose of adjusting image densities in image stabilization control. The detection results are output to the controller 60.

The color toner density sensor 14*b* is provided with an LED element 141*b* and two photodiodes serving as photodetectors 142*b* and 143*b*. The photodetectors 142*b* and 143*b* are arranged so that the positions detectable by the respective photodetectors on the image carrying surface of the intermediate transfer belt 11 are aligned along the main scanning direction.

The color toner density sensor 14*b* irradiates a registration pattern with light emitted by the LED element 141*b*, receives regular reflection light and diffuse reflection light from the registration pattern with the photodetectors 142*b* and 143*b*, respectively, and outputs the difference between a voltage signal corresponding to the received regular reflection light and the a voltage signal corresponding to the received diffuse reflection light to the controller 60.

In addition, the color toner density sensor 14*b* is also used to detect the toner density of each of a plurality of patch toner images formed in each color of Y, M, and C with different toner densities for the purpose of adjusting adjust image densities in image stabilization control. The detection results are output to the controller 60. Note that the toner density of patch toner images in K color may be detected also by the color toner density sensor 14*b*.

The black toner density sensor 14*a* and the color toner density sensor 14*b* are arranged such that the relative positional relation among the LED element 141*a*, the photodetector 142*a*, and one of a pair of registration patterns having the same color and arranged side by side along the main scanning direction is identical to the relative positional relation among the LED element 141*b*, the photodetector 142*b*, and the other one of the registration patterns in the pair.

With reference back to FIG. 2, the array deviation storage unit 607 stores the amounts of array deviation. Each "amount of array deviation" refers to an index value indicating the amount of deviation between the positions detected by using the respective toner sensors for a pair of registration patterns of the same color arranged side by side along the main scanning direction. Particularly, this amount of array deviation corresponds to the amount of offset deviation occurring between the thus detected positions (the barycenter positions, which will be described later) when each registration pattern is formed without any positional deviation. That is, this amount of offset deviation results from the difference in structure between the respective toner density sensors.

Figure 4A:
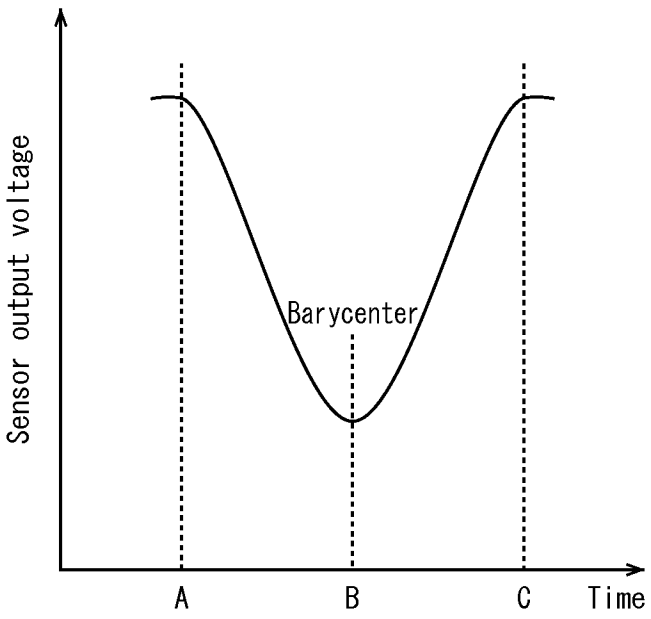
FIG. 4A shows an example of an waveform output by a black toner density sensor 14*a* when detecting a sub-scanning direction registration pattern Y (i.e., sub-scanning registration detecting pattern Y included in an array Pa shown in FIG. 3).
Figure 4B:
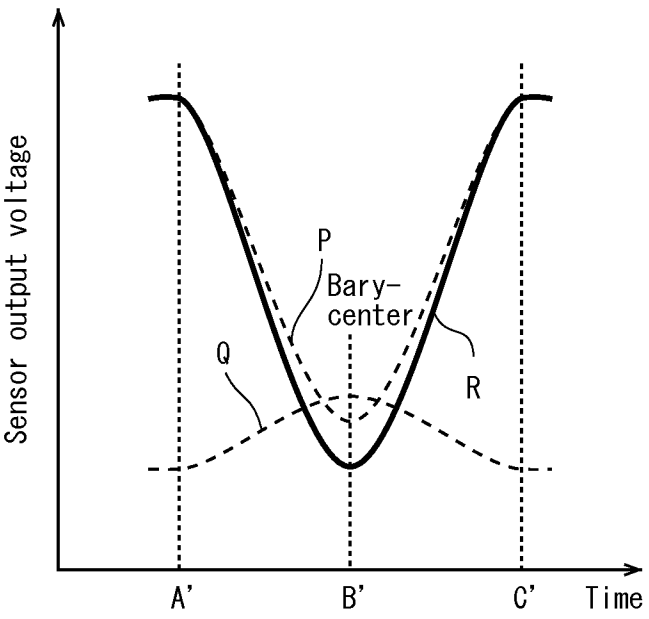
FIG. 4B shows an example of an waveform output by a color toner density sensor 14*b* when detecting a sub-scanning direction registration pattern Y (i.e., sub-scanning registration detecting pattern Y included in an array Pb shown in FIG. 3).

FIG. 4A shows an exemplary waveform output by the black toner density sensor 14*a* when detecting one of sub-scanning registration detecting patterns Y (i.e., the sub-scanning registration detecting pattern Y included in the array Pa shown in FIG. 3). FIG. 4B shows an exemplary waveform output by the color toner density sensor 14*b* when detecting the other sub-scanning registration detecting pattern Y (i.e., the sub-scanning registration detecting pattern Y included in the array Pb shown in FIG. 3). In each figure, the vertical axis represents the output voltage of the corresponding sensor and the horizontal axis represents time.

Figure 5:
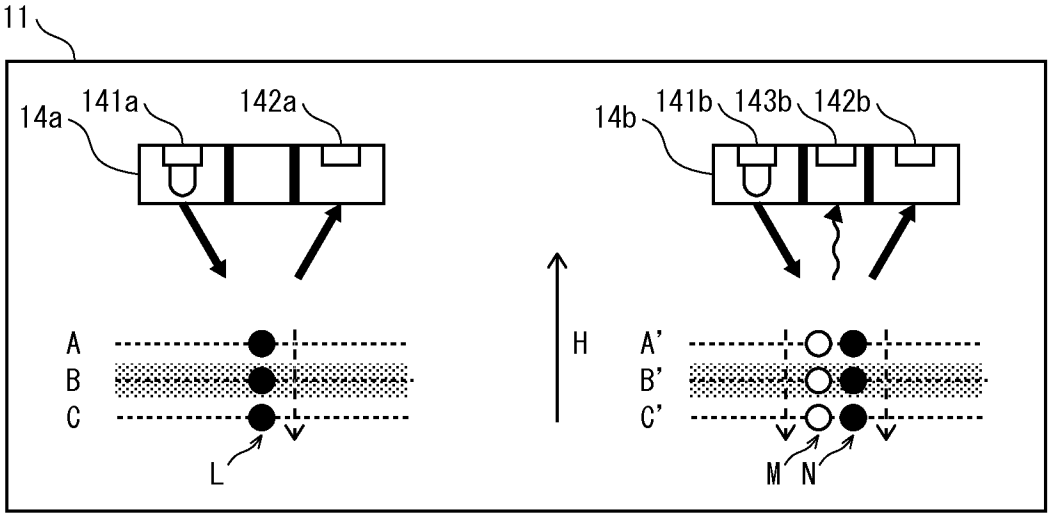
FIG. 5 schematically shows the relative positional relation among the detection positions of two photodetectors of the black toner density sensor 14*a* and a photodetector of the color toner density sensor 14*b*, and the pair of sub-scanning registration detecting patterns Y (one included in the array Pa and the other in Pb shown in FIG. 3) that are formed side by side along the main scanning direction on the image carrying surface of the intermediate transfer belt 11.

In FIG. 4A, the reference signs A, B, and C indicate temporal points corresponding, in the temporal coordinates, to the respective detection positions A, B, and C to be detected by the photodetector 142*a* of the black toner density sensor 14*a* relative to one of the sub-scanning registration detecting patterns Y as shown in FIG. 5, which will be described later. Similarly, the reference signs A', B', and C' in FIG. 4B indicate temporal points corresponding, in the temporal coordinates, to the respective detection positions A', B', and C' to be detected by the photodetectors 142*b* and 143*b* of the color toner density sensor 14*b* relative to the other of the sub-scanning registration detecting pattern Y as shown in FIG. 5.

In FIG. 4B, the reference sign P denotes the output waveform representing the regular reflection light components detected from the sub-scanning registration detecting pattern Y, and the reference sign Q denotes the output waveform representing the diffuse reflection light components detected from the sub-scanning registration detecting pattern Y. The reference sign R denotes the output waveform indicating the difference between the light components of the respective types of reflection detected for that pattern (i.e., the output waveform indicating the difference between the regular reflection light components and the diffuse reflection light components).

FIG. 5 schematically shows the relative positional relation among the detection positions of the respective photodetectors of the black toner density sensor 14*a* and the color toner density sensor 14*b*, and the pair of sub-scanning registration detecting patterns Y (one included in the array Pa and the other in Pb shown in FIG. 3) that are formed side by side along the main scanning direction on the image carrying surface. More specifically, the left-hand side of FIG. 5 shows the relative positional relation of the detection positions of the photodetector 142*a* of the black toner density sensor 14*a* with respect to the sub-scanning registration detecting pattern Y (the hatched portion) that is included in the array Pa. The right-hand side of FIG. 5 shows the relative positional relation of the detection positions of the photodetectors 142*b* and 143*b* of the color toner density sensor 14*b* with respect to the sub-scanning registration detecting pattern Y (the hatched portion) that is included in the array Pb.

In FIG. 5, the reference sign 11 denotes the intermediate transfer belt, the arrow H indicates the rotation direction of the intermediate transfer belt 11 (i.e., the sub-scanning direction). The position detected by each photodetector moves relatively in the reverse direction of the rotation direction as the intermediate transfer belt 11 rotates. Of the arrays L, M, and N of circular marks (solid circles or open circles) aligned along the sub-scanning direction shown in the figure, the array L corresponds to the detection positions of the photodetector 142*a*, the array M corresponds to the detection positions of the photodetector 143*b*, and the array N corresponds to the detection positions of the photodetector 142*b*. The marks in each array represent the detection positions moving relatively in the reverse direction (the direction indicated by the dotted line).

In addition, the reference sign 14*a* in the figure denotes the black toner density sensor, whereas the reference sign 14*b* denotes the color toner density sensor. The reference signs 141*a* and 141*b* denote the LED elements, the reference signs 142*a* and 142*b* denote the photodetectors for receiving regular reflection light, and the reference sign 143*b* denotes the photodetector for receiving diffuse reflection light.

With respect to the detection positions represented by solid circles in the array L, at the temporal point A in the temporal coordinates, the corresponding detection position is located downstream from the sub-scanning registration detecting pattern Y (i.e., downstream from the hatched portion) in the sub-scanning direction. Therefore, as is seen from the output waveform in FIG. 4A, the sensor output voltage is not yet on the decrease at the temporal point A in the temporal coordinates. At the temporal point B in the temporal coordinates, the corresponding detection position falls on the center of the sub-scanning registration detecting pattern Y (the hatched portion) in the sub-scanning direction. Consequently, the sensor output voltage decreases to the minimum at the temporal point B in the temporal coordinates of the output waveform show in FIG. 4A. This temporal point B is referred to as "barycenter position". More specifically, let M denote the mean value between the maximum and minimum sensor output voltages in the waveform output for the registration pattern. Then the "barycenter position" refers to a temporal point corresponding, in the temporal coordinates, to the barycenter of a region of the output waveform where the output voltages are below the value of M.

In addition, at the temporal point C in the temporal coordinates, the corresponding detection position comes to pass the trailing edge of the sub-scanning registration detecting pattern (hatched portion) in the sub-scanning direction. Therefore, the sensor output voltage reaches its maximum at the temporal point C in the temporal coordinates of the output waveform of FIG. 4A. In a manner described above, when the black toner density sensor 14*a* detects the sub-scanning registration detecting pattern Y, the output waveform shown in FIG. 4A is obtained.

As described above, the black toner density sensor 14*a* and the color toner density sensor 14*b* are arranged such that the relative positional relation among the LED element 141*a*, the photodetector 142*a*, and one of a pair of registration patterns of the same color and side by side along the main scanning direction is identical to the relative positional relation among the LED element 141*b*, the photodetector 142*b*, and the other one of the registration patterns in the pair. Hence, a description similar to that directed to the array L can be applied to the array N of solid circles representing the detection positions of the photodetector 142*b*. That is, the sensor output voltage changes in a similar manner as the detection positions sequentially move with the transition of the temporal points A', B', and C', which correspond to the temporal points A, B, and C. Consequently, the output waveform (denoted by the reference sign P in FIG. 4B) that is the same as the output waveform shown in FIG. 4A is obtained. In the case where the sub-scanning registration detecting patterns Y shown in the left-hand side and right-hand side of FIG. 5 do not have any positional deviation, the barycenter positions B and B' of the respective output waveforms coincide (the distance between the barycenter positions is equal to the reference value determined for the pair of sub-scanning registration detecting patterns).

Also as described above, the photodetectors 142*b* and 143*b* are arranged such that their respective detection positions are in alignment along the main scanning direction at any given point in time, as indicated by the array N of the solid circles and the array M of the open circles in FIG. 5. Therefore, when the temporal point corresponding to a detection position of the photodetector 142*b* coincides with the barycenter position B', the detection position of the photodetector 143*b* also comes to the center of the sub-scanning registration detecting pattern Y (the hatched portion) in the sub-scanning direction. Consequently, the sensor output voltage denoted by the reference sign Q in FIG. 4B reaches its maximum (which means that the sensor output voltage corresponding to the amount of diffuse reflection light reaches its maximum).

Accordingly, in the output waveform R indicating the difference between P and Q, the sensor output voltage is lowest at the barycenter position B' of the output waveform P, which means that the barycenter positions of the output waveforms P and R coincide.

That is to say, when a pair of sub-scanning registration detecting patterns Y are detected, the barycenter position of the waveform output by the black toner density sensor 14*a*, which detects regular reflection light, coincides with the barycenter position of the waveform output by the color toner density sensor 14*b*, which detects the difference between regular reflection light and diffuse reflection light. Thus, it is determined that the amount of array deviation for the pair of sub-scanning registration detecting patterns Y is equal to zero. Since the colors M and C have the same properties as the color Y, the amount of array deviation for the pair of sub-scanning registration detecting patterns of a corresponding color is also determined to be zero similarly to the case of the color Y.

Note that the color K is not affected by diffuse reflection light as will be described later. Thus, the amount of array deviation for the pair of sub-scanning registration detecting patterns K is also determined to be zero.

Figure 6A:
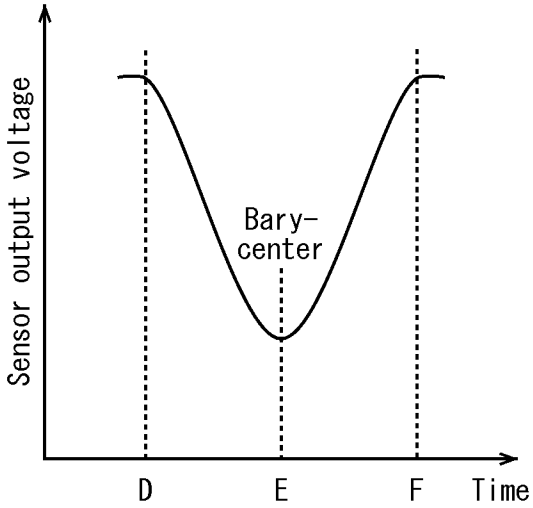
FIG. 6A shows an exemplary waveform output by the black toner density sensor 14*a* when detecting a main scanning registration detecting pattern Y (i.e., main scanning registration detecting pattern Y included in an array Qa shown in FIG. 3).
Figure 6B:
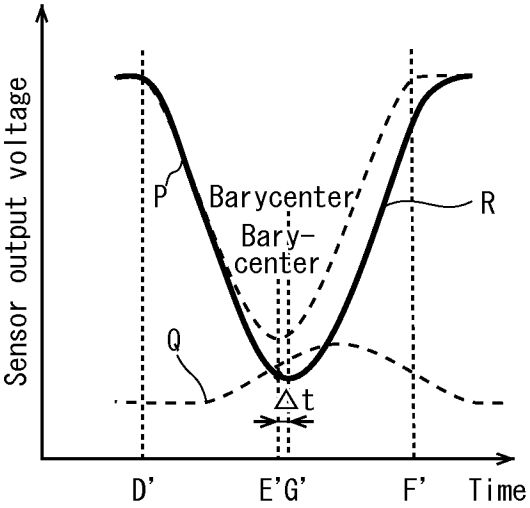
FIG. 6B shows an exemplary waveform output by the color toner density sensor 14*b* when detecting one of the main scanning registration detecting patterns Y (i.e., the main scanning registration detecting pattern Y included in the array Qb shown in FIG. 3).
Figure 6C:
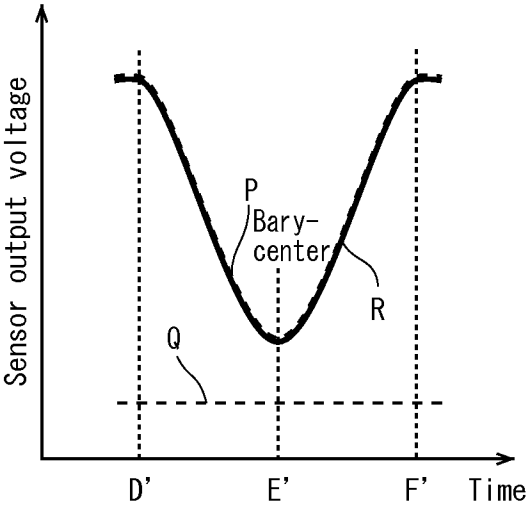
FIG. 6C shows an exemplary waveform output by the color toner density sensor 14*b* when detecting one of the main scanning registration detecting patterns K (i.e., the main scanning registration detecting pattern K included in the array Qb shown in FIG. 3).

FIG. 6A shows an exemplary waveform output by the black toner density sensor 14*a* when detecting one of main scanning registration detecting patterns Y (i.e., the main scanning registration detecting pattern Y included in the array Qa shown in FIG. 3). FIG. 6B shows an exemplary waveform output by the color toner density sensor 14*b* when detecting the other main scanning registration detecting pattern Y (i.e., the main scanning registration detecting pattern Y included in the array Qb shown in FIG. 3). FIG. 6C shows an exemplary output waveform produced by the color toner density sensor 14*b* when detecting one of the main scanning registration detecting patterns K (i.e., the main scanning registration detecting pattern K included in the array Qb shown in FIG. 3). In each figure, the vertical axis represents the output voltage of the corresponding sensor and the horizontal axis represents time.

Figure 7:
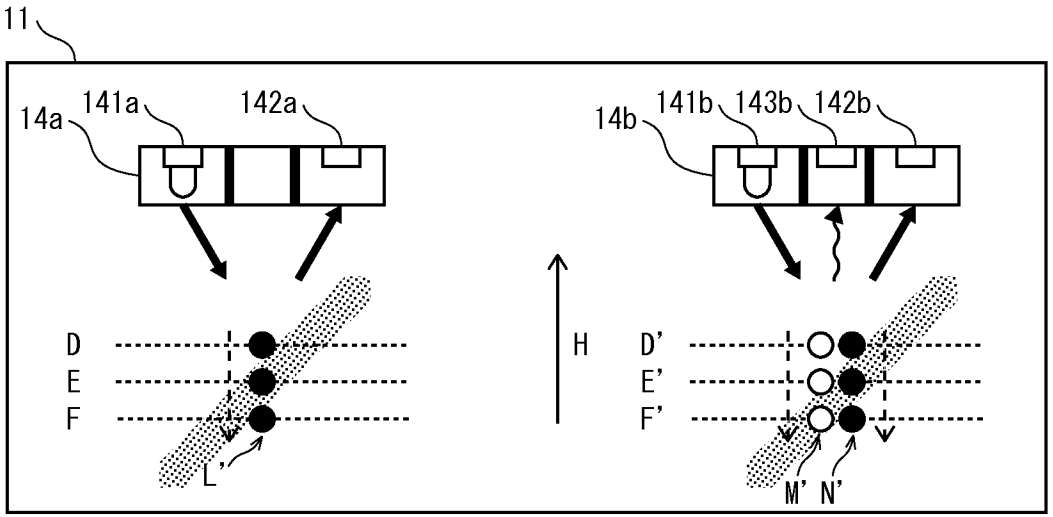
FIG. 7 schematically shows the relative positional relation among the respective photodetectors of the black toner density sensor 14*a* and the color toner density sensor 14*b*, and the pair of main scanning registration detecting patterns Y (one included in the array Qa and the other in the array Qb shown in FIG. 3) formed side by side along the main scanning direction on the image carrying surface of the intermediate transfer belt 11.

In FIG. 6A, the reference signs D, E, and F indicate temporal points corresponding, in the temporal coordinates, to the respective detection positions D, E, and F to be detected by the photodetector 142*a* of the black toner density sensor 14*a* relative to one of main scanning registration detecting patterns Y as shown in FIG. 7, which will be described later. Similarly, the reference signs D', E', and F' indicate temporal points corresponding, in the temporal coordinates, to the respective detection positions D', E', and F' to be detected by the photodetectors 142*b* and 143*b* of the color toner density sensor 14*b* relative to the other main scanning registration detecting pattern Y as shown in FIG. 7.

In FIG. 6B, the reference sign P denotes the output waveform representing the regular reflection light components detected from the main scanning registration detecting pattern Y, and the reference sign Q denote the diffuse reflection light components detected from the main scanning registration detecting pattern Y. The reference sign R denotes the output waveform indicating the difference between the light components of the respective types of reflection detected for that pattern (i.e., the output waveform indicating the difference between the regular reflection light components and the diffuse reflection light components).

FIG. 7 schematically shows the relative positional relation among the respective photodetectors of the black toner density sensor 14*a* and the color toner density sensor 14*b*, and the pair of main scanning registration detecting patterns Y (one included in the array Qa and the other in the array Qb shown in FIG. 3) formed side by side along the main scanning direction on the image carrying surface.

More specifically, the left-hand side of FIG. 7 shows the relative positional relation of the detection positions of the photodetector 142*a* of the black toner density sensor 14*a* with respect to the main scanning registration detecting pattern Y (the hatched portion) that is included in the array Qa. The right-hand side of FIG. 7 shows the relative positional relation of the detection positions of the photodetectors 142*b* and 143*b* of the color toner density sensor 14*b* with respect to the main scanning registration detecting pattern Y (the hatched portion) that is included in the array Qb.

In FIG. 7, the reference sign 11 denotes the intermediate transfer belt, the arrow H indicates the rotation direction of the intermediate transfer belt 11 (i.e., the sub-scanning direction). The positions detected by the respective photodetectors move relatively in the reverse direction of the rotation direction as the intermediate transfer belt 11 rotates. Of the arrays L', M', and N' of circular marks (solid circles and open circles) aligned along the sub-scanning direction shown in the figure, the array L' corresponds to the detection positions of the photodetector 142*a*, the array M' corresponds to the detection positions of the photodetector 143*b*, and the array N' corresponds to the detection positions of the photodetector 142*b*. The marks in each array represent the detection positions moving relatively in the reverse direction (the direction indicated by the dotted line).

In addition, the reference sign 14*a* in the figure denotes the black toner density sensor, whereas the reference sign 14*b* denotes the color toner density sensor. The reference signs 141*a* and 141*b* denote the LED elements, the reference signs 142*a* and 142*b* denote the photodetectors for receiving regular reflection light, and the reference sign 143*b* denotes the photodetector for receiving diffuse reflection light.

With respect to the detection positions represented by solid circles in the array L', at the temporal point D in the temporal coordinates, the corresponding detection position is located downstream from the main scanning registration detecting pattern Y (i.e., downstream from the hatched portion) in the sub-scanning direction. Therefore, as is seen from the output waveform in FIG. 6A, the sensor output voltage is not yet on the decrease at the temporal point D in the temporal coordinates. At the temporal point E in the temporal coordinates, the corresponding detection position falls on the center of the main scanning registration detecting pattern Y (the hatched portion) in the sub-scanning direction. Consequently, the sensor output voltage decreases to the minimum at the temporal point E in the temporal coordinates of the output waveform show in FIG. 6A. That is, the temporal point E is the barycenter position.

In addition, at the temporal point F in the temporal coordinates, the LED element comes to pass the trailing edge of the main scanning registration detecting pattern Y (hatched portion) in the sub-scanning direction. Therefore, the sensor output voltage reaches its maximum at the temporal point F in the temporal coordinates of the output waveform of FIG. 6A. In a manner described above, when the black toner density sensor 14*a* detects the main scanning registration detecting pattern Y, the output waveform shown in FIG. 6A is obtained.

Note that FIG. 7 does not include an illustration corresponding to FIG. 6C. Since almost no diffuse reflection light is received from the main scanning registration detecting pattern K, the output of the photodetector 143*b* detecting diffuse reflection light is equal to zero. Consequently, the output of the color toner density sensor 14*b* is substantially equal to the output of the photodetector 142*b* detecting regular reflection light and thus exhibits the same behavior as the black toner density sensor 14*a*.

As described above, the black toner density sensor 14*a* and the color toner density sensor 14*b* are arranged such that the relative positional relation among the LED element 141*a*, the photodetector 142*a*, and one of the main scanning registration detecting patterns Y is identical to the relative positional relation among the LED element 141*b*, the photodetector 142*b*, and the other one of the main scanning registration detecting patterns Y. Hence, a description similar to that directed to the array L' can be applied to the array N' of solid circles shown in FIG. 7 and representing the detection positions of the photodetector 142*b*. That is, the sensor output voltage changes in a similar manner as the detection positions sequentially move with the transition of the temporal points D', E', and F', which correspond to the temporal points D, E, and F. Consequently, the output waveform (denoted by the reference sign P in FIG. 6B) that is the same as the output waveform shown in FIG. 6A is obtained. In the case where the main scanning registration detecting patterns Y shown in the left-hand side and right-hand side of FIG. 7 do not have any positional deviation, the barycenter positions E and E' of the respective output waveforms coincide (the distance between the barycenter positions is equal to the reference value determined for the pair of main scanning registration detecting patterns).

As described above, the photodetectors 142*b* and 143*b* are arranged such that their respective detection positions are in alignment along the main scanning direction at any given point in time, as indicated by the array N' of the solid circles and the array M' of the open circles in FIG. 7. Yet, each main scanning registration detecting pattern Y is elongated along the direction inclined at 45° to the main scanning direction. Therefore, there is a time lag between the times at which the detection positions of the respective photodetectors reach the center of the main scanning registration detecting pattern Y in the sub-scanning direction.

Due to the time lag, as shown in FIG. 7, at the time when the detection position of the photodetector 142*b* reaches the center of the main scanning registration detecting pattern Y (hatched portion) in the sub-scanning direction (i.e., at the temporal point E' in the temporal coordinates), the detection position of the photodetector 143*b* has not yet reached the center. The detection position of the photodetector 143*b* reaches the center later than the temporal point E'.

Accordingly, as shown in FIG. 6B, with respect to the output waveform R indicating the difference in sensor output voltage between the output waveforms P and Q, the barycenter position E' of the output waveform P does not coincide with the barycenter position G' of the output waveform R, resulting the positional deviation (denoted by the reference sign Δt) between the barycenter positions E' and G'. Thus, the amount of array deviation in this case is not equal to zero. Since the colors M and C have the same properties as the color Y, the amount of array deviation for the pair of main scanning registration detecting patterns of a corresponding color is not equal to zero similarly to the case of the color Y.

On the other hand, almost no diffuse reflection light is received from the main scanning registration detecting pattern K and the output of the photodetector 143*b* detecting diffuse reflection light does not affect the output of the color toner density sensor 14*b*. Therefore, the output waveform Q does not affect the barycenter position E' of the output waveform P. Accordingly, as shown in FIG. 6C, with respect to the output waveform R, the barycenter position of the output waveform R coincides with the barycenter position E' of the output waveform of the output waveform P. Hence, the amount of array deviation in this case is determined to be zero.

As described above, when the black toner density sensor 14*a* and the color toner density sensor 14*b* detect a pair of identical registration patterns of the same color, the barycenter positions as calculated involves an array deviation with respect to either or both of a pair of main scanning registration detecting patterns and a pair of sub-scanning registration detecting pattern, depending on the relation between (i) the direction along which the respective detection positions of the photodetectors 142*b* and 143*b* are arranged and (ii) the elongated direction of each registration pattern.

More specifically, for example, in the case where the direction along which the respective detection positions of the photodetectors 142*b* and 143*b* are aligned coincides with the elongated direction of each main scanning registration detecting pattern, the array deviation occurs between a pair of sub-scanning registration detecting patterns rather than between a pair of main scanning registration detecting patterns, which is reverse to the present embodiment.

In the case where the direction along which the respective detection positions of the photodetectors 142*b* and 143*b* are aligned does not coincide with the elongated direction of either of a main scanning registration detecting pattern or a sub-scanning registration detecting pattern, the array deviation occurs between both the pairs. Note, however, that since no diffuse reflection light is received from the registration detection patterns K, any array deviation does not occur either between main scanning registration detecting patterns K or between sub-scanning registration detecting patterns K.

As described above, when toner density sensors differing in the photodetector configuration are used to calculate a positional deviation between a pair of registration patterns for the purpose of registration error correction, an array deviation occurs due to the difference in the photodetectors. Therefore, in the case of using the above sensors, it is impossible to obtain the accurate amount of positional deviation of registration patterns, by employing the method that works to calculate an amount of positional deviation using the toner sensors having the same photodetector configuration.

It is therefore necessary to determine, at the manufacturing side in advance, the amounts of array deviation by, for example, conducting tests and to store the determined amounts of array deviation to the array deviation storage unit 608. Then, by using the same method that works with a pair of reflection type toner density sensors having the same photodetector configuration, the barycenter positions of a pair of registration patterns of the same color arranged side by side along the main scanning direction is calculated. Subsequently, the calculated barycenter positions are corrected to offset the amount of array deviation determined in advance from the amounts of the positional deviation between the calculated barycenter positions. After this correction is made, the amount of positional deviation for each registration pattern is calculated. This correction eliminates the influence of array deviation inherent to the sensors and thus the accurate amount of positional deviation can be obtained.

For example, the amount of array deviation is determined for each pair of sub-scanning registration detecting patterns and of main scanning registration detecting patterns in each color of Y, M, and C as follows. That is, the output waveforms as shown in FIGS. 4A, 4B, 6A, and 6B are obtained for each color. Then, the positional difference is calculated for each color. between (i) the barycenter position of the output waveform indicating regular reflection light components and (ii) the barycenter position of the output waveform indicating the difference between the regular reflection light components and the diffuse reflection light components. Finally, the average value of the positional difference is calculated for each color and determined as the amount of array deviation for that pair of registration patterns. Optionally, in view of the fact that the influence of the different properties among the colors Y, M, and C is negligible, the positional difference between the barycenter positions calculated for a pair of registration patterns of a specific color (Y, for example) may be determined to be the amount of array deviation for each of Y, M, and C. With respect to the color K, no diffuse reflection occurs and thus no positional difference occurs between the barycenter positions of the respective output waveforms. Therefore, the amount of array deviation is determined to be zero.

The amounts of array deviation determined for the pairs of main registration patterns and the pairs of sub-scanning registration detecting patterns of the respective colors of Y, M, and C are stored for the corresponding registration pattern in the array deviation storage unit 607.

With reference back to FIG. 2, for each pair of registration patterns formed in the same color and side by side along the main scanning direction and the sub-scanning direction, the correction amount calculating unit 608 calculates the barycenter position of each registration pattern based on the waveforms output from the black toner density sensor 14*a* and the color toner density sensor 14*b*.

In addition, for each registration pattern of each color (Y, M, and C) subjected to the barycenter position calculation, the correction amount calculating unit 608 calculates the amount of positional deviation with respect to the registration pattern of the reference color (i.e., the color K). A specific explanation is given with reference to FIG. 3 as an example. Regarding the arrays Pa and Pb of sub-scanning registration detecting patterns, the correction amount calculating unit 608 calculates the amount of positional deviation in the following manner.

With respect to each of two sub-scanning registration detecting patterns of the reference color (K) arranged side by side along the main scanning direction and included in the respective arrays of Pa and Pb, the correction amount calculating unit 608 calculates the distance between the sub-scanning registration detecting pattern K and each of the sub-scanning registration detecting patterns Y, M, and C included in the corresponding array and having been subjected to the barycenter position calculation. Each distance is calculated using the equations (1) to (6) below. The following defines the reference signs used in the equations.

In the equations, V denotes the running speed of the intermediate transfer belt 11 at the time of image formation. In addition, Ka, Ya, Ma, and Ca respectively denote the barycenter positions calculated for the sub-scanning registration detecting patterns K, Y, M, and C included in the array Pa. In addition, Kb, Yb, Mb, and Cb respectively denote the barycenter positions calculated for the sub-scanning registration detecting patterns K, Y, M, and C included in the array Pb.

Further, Dkya, Dkma, and Dkca respectively denote the distances between the sub-scanning registration detecting pattern K and each of the sub-scanning registration detecting patterns Y, M, and C included in the array Pa. In addition, Dkyb, Dkmb, and Dkcb respectively denote the distances between the sub-scanning registration detecting pattern K and each of the sub-scanning registration detecting patterns Y, M, and C included in the array Pb.

$$Dkya=Vx(Ya-Ka) \quad (1)$$

$$Dkma=Vx(Ma-Ka) \quad (2)$$

$$Dkca=Vx(Ca-Ka) \quad (3)$$

$$Dkyb=Vx(Yb-Kb) \quad (4)$$

$$Dkmb=Vx(Mb-Kb) \quad (5)$$

$$Dkcb=Vx(Cb-Kb) \quad (6)$$

Next, the correction amount calculating unit 608 calculates the amount of the positional deviation for each of the sub-scanning registration detecting patterns Y, M, and C in each array with respect to the sub-scanning registration detecting pattern of the reference color (i.e., the color K) in the array.

Here, let D denote the distance between the sub-scanning registration detecting patterns K and Y, Y and M, and M and C in each array in the sub-scanning direction in the case where the respective sub-scanning registration detecting patterns are formed on the intermediate transfer belt 11 without any positional deviation due to misregistration. Then, the positional deviation of each of sub-scanning registration detecting patterns Y, M, and C in each array with respect to sub-scanning registration detecting pattern K in the array is calculated using the equations (7) to (12) below. The following defines the reference signs used in the equations.

In the equations, DDya, DDma, DDca, and DDkca respectively denote the amounts of positional deviation for the sub-scanning registration detecting patterns Y, M, and C in the array Pa. In addition, DDyb, DDmb, and DDcb denote the amounts of the positional deviation for the sub-scanning registration detecting patterns Y, M, and C in the array Pb.

$$DDya=D-Dkya \quad (7)$$

$$DDma=2D-Dkma \quad (8)$$

$$DDca=3D-Dkca \quad (9)$$

$$DDyb=D-Dkyb \quad (10)$$

$$DDmb=2D-Dkmb \quad (11)$$

$$DDcb=3D-Dkcb \quad (12)$$

According to the present embodiment, the direction along which each of the sub-scanning registration detecting patterns Y, M, and C is elongated (main scanning direction) matches the direction along which the detection positions of the photodetectors 142*b* and 143*b* of the color toner density sensor 14*b* are arranged. Therefore, the amount of array deviation is determined to be zero. Consequently, the amount of array deviation is not taken into consideration in the step of calculating the positional deviation for each of the sub-scanning registration detecting patterns Y, M, and C in the respective arrays Pa and Pb.

On the other hand, regarding the arrays Qa and Qb of main scanning registration detecting patterns, the correction amount calculating unit 608 calculates the amounts of positional deviation in the following manner. The correction amount calculating unit 608 corrects the barycenter position of each of the main scanning registration detecting patterns Y, M, and C in the array Pb by the amount of array deviation (here, this amount is denoted by X) stored in the array deviation storage unit 607 in a manner that the barycenter position as corrected is closer to the barycenter position as calculated for the reference color (the color K).

More specifically, let Kbb, Ybb, Mbb, and Cbb respectively denote the barycenter positions calculated for the main scanning registration detecting patterns K, Y, M, and C that are included in the array Qb. In addition, let MKbb, MYbb, MMbb, and MCbb respectively denote the corrected barycenter positions of the main scanning registration detecting patterns K, Y, M, and C. Then, the calculated position of each barycenter position is corrected according to the following equations (13) to (17).

$$MKbb=Kbb \quad (13)$$

$$MYbb=Ybb-X \quad (14)$$

$$MMbb=Mbb-X \quad (15)$$

$$MCbb=Cbb-X \quad (16)$$

The above corrections offset the positional deviation that occurs between the barycenter positions between the arrays Qa and Qb of the pairs of main scanning registration detecting patterns Y, M, and C resulting from the fact that the elongated direction of each of the main scanning registration detecting patterns Y, M and C does not match the direction along which the detection positions of the photodetectors 142*b* and 143*b* of the color toner density sensor 14*b* are aligned.

Next, the correction amount calculating unit 608 calculates, for each color of K, Y, M, and C, the distance between the sub-scanning registration detecting pattern and main scanning registration detecting pattern of the same color by using the equations (17) to (24) below based on the barycenter positions as corrected. The following defines the reference signs used in the equations.

In the equations, DEka, DEya, DEma, and DEca respectively denote, for each of K, Y, M, and C, the distances between the main scanning registration detecting pattern and the sub-scanning registration detecting pattern of the same color that are contained in the array Qa. In addition, DEkb, DEyb, DEmb, and DEcb respectively denote, for each of K, Y, M, and C, the distance between the main scanning registration detecting pattern and the sub-scanning registration detecting pattern of the same color that are contained in the array Qb.

In addition, Kaa, Yaa, Maa, and Caa respectively denote the barycenter positions calculated for the main scanning registration detecting patterns K, Y, M, and C that are included in the array Qa.

$$DEka=Vx(Kaa-Ka) \quad (17)$$

$$DEya=Vx(Yaa-Ya) \quad (18)$$

$$DEma=Vx(Maa-Ma) \quad (19)$$

$$DEca=Vx(Caa-Ca) \quad (20)$$

$$DEkb=Vx(Kbb-Kb) \quad (21)$$

$$DEyb=Vx(MYbb-Yb) \quad (22)$$

$$DEmb=Vx(MMbb-Mb) \quad (23)$$

$$DEcb=Vx(MCbb-Cb) \quad (24)$$

Next, the correction amount calculating unit 608 calculates, based on the thus calculated distances, the amount of positional deviation of each of the main scanning registration detecting patterns Y, M, and C by using, as the reference, the distance between the main scanning registration detecting pattern K and the sub-scanning registration detecting pattern K. The respective amounts of positional deviation are given by the equations (25) to (30) below. In the equations, EEya, EEma, and EEca respectively denote the amounts of positional deviation for the main scanning registration detecting patterns Y, M, and C included in the array Qa. In addition, EEyb, EEmb, and EEcb respectively denote the amounts of positional deviation for the main scanning registration detecting patterns Y, M, and C included in the array Qb.

Note that each main scanning registration detecting pattern is formed so that it elongates along the direction inclined at 45° to the sub-scanning direction. Hence, the difference between the distance calculated for the reference color (the color K) and the distance calculated for each of Y, M, and C is equal to the positional deviation between the main scanning registration detecting pattern K and each of the main scanning registration detecting patterns Y, M, and C in the main scanning direction.

$$EEya=DEka-DEya \quad (25)$$

$$EEma=DEka-DEma \quad (26)$$

$$EEca=DEka-DEca \quad (27)$$

$$EEyb=DEkb-DEyb \quad (28)$$

$$EEmb=DEkb-DEmb \quad (29)$$

$$EEcb=DEkb-DEcb \quad (30)$$

The correction amount storage unit 609 stores the amounts of positional deviation calculated by the correction amount calculating unit 608 for the registration patterns (hereinafter, the "registration patterns" refer collectively to the main scanning registration detecting patterns and the sub-scanning registration detecting patterns) Y, M, and C. The deviation correction executing unit 610 adjusts the timings for image forming processes such as exposure timing based on the amounts of positional deviation stored in the correction amount storage unit 609 for the registration patterns of the respective colors.

The operation panel 7 is provided with a plurality of input keys and a liquid crystal display. A touch panel is laminated on the surface of the liquid crystal display. A user instruction is input with a touch operation on the touch panel or a key operation of the keys, and the user instruction is passed to the controller 60. The image reader unit 8 is formed from an image input device such as a scanner and reads an image of text and pictures contained on an original to form image data.

[3] Operations of Calculating Positional Deviation in Sub-Scanning Direction

Figure 8:
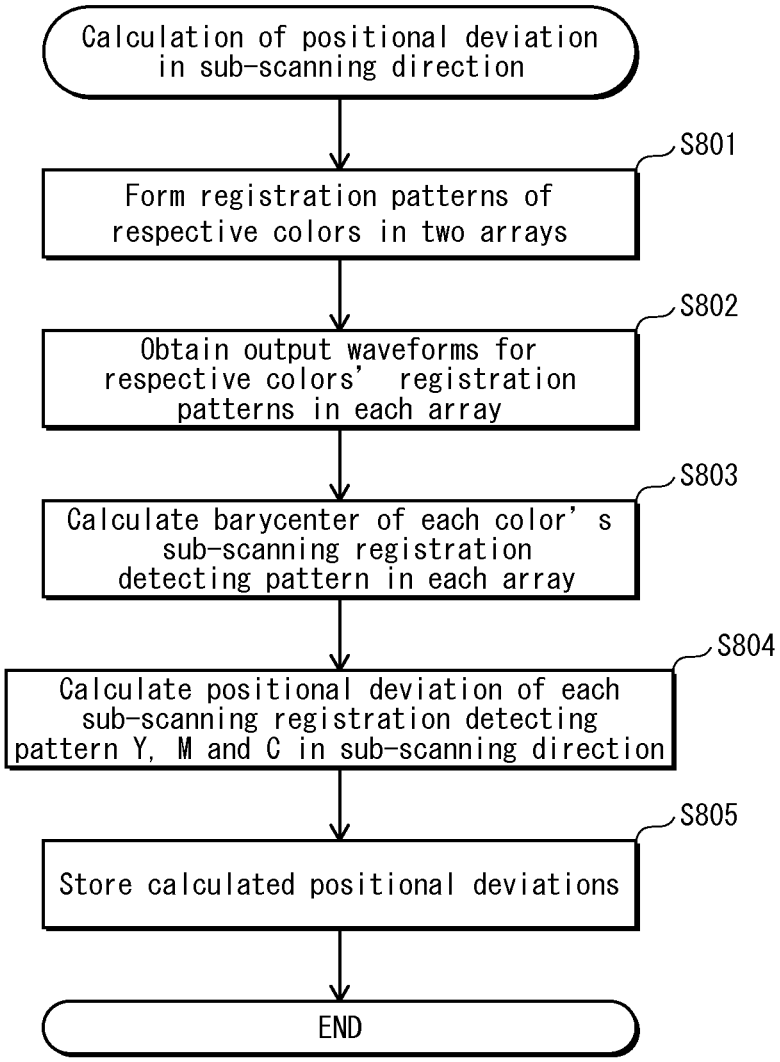
FIG. 8 is a flowchart of operations performed by the controller 60 to calculate the amounts of positional deviation in the sub-scanning direction.

FIG. 8 is a flowchart of operations performed by the controller 60 to calculate the amounts of positional deviation in the sub-scanning direction. When the timing for calculating the positional deviation of registration patterns is reached, the controller 60 controls the pattern forming unit 60 to read pattern images from the ROM 602 where the registration patterns are stored in advance, and then to form the read registration patterns in two arrays along the sub-scanning direction on the image carrying surface of the intermediate transfer belt 11 so that each array contains the registration patterns K, Y, M, and Y (Step S801).

Note that the "timing for calculating the positional deviation of registration patterns" is a specific timing determined in advance, such as at the time of power on, after power on, after printing a predetermined number of sheets, and upon receipt of a user instruction for making registration correction.

Next, the controller 60 obtains the waveforms output from the black toner density sensor 14*a* and the color toner density sensor 14*b* when the sensors detect the registration patterns of the respective colors (Step S802). The controller 60 then controls the correction amount calculating unit 609 to calculate the barycenter position of each of the sub-scanning registration detecting patterns K, Y, M, and C in each array (Step S803).

Then, the controller 60 controls the correction amount calculating unit 608 to calculate the amount of positional deviation for each of the sub-scanning registration detecting pattern Y, M, and C with respect to the sub-scanning registration detecting pattern of the reference color (the color K), based on the barycenter positions of the sub-scanning registration detecting patterns of the respective colors calculated for the respective arrays (Step S804). Then, the controller 60 stores the calculated amounts of the positional deviation in the correction amount storage unit 610, so that the stored amounts of positional deviation are used to adjust the timings for image forming processes such as exposure timing (Step S805).

[4] Operation of Calculating Positional Deviation in Main Scanning Direction

Figure 9:
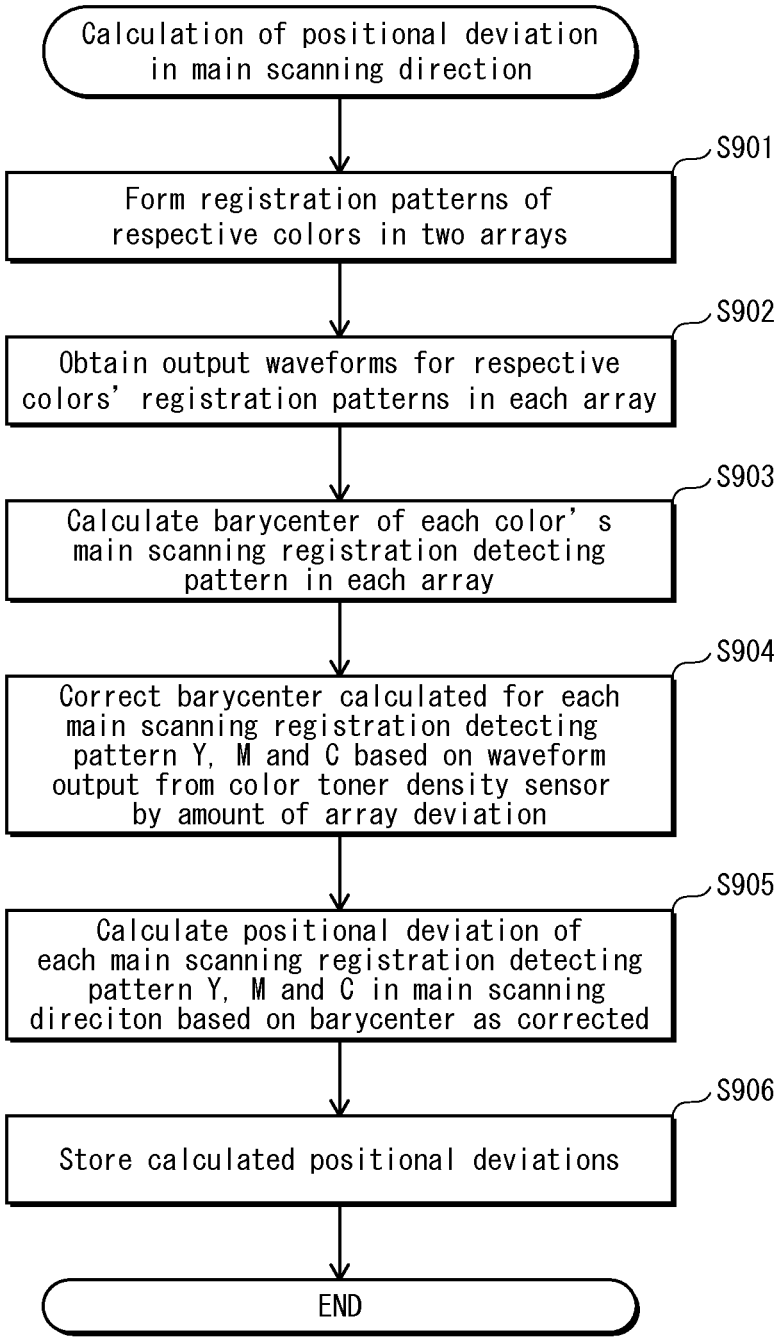
FIG. 9 is a flowchart of operations performed by the controller 60 to calculate the amounts of positional deviation in the main scanning direction.

FIG. 9 is a flowchart of operations performed by the controller 60 to calculate the amounts of positional deviation in the main scanning direction. When the predetermined timing for calculating the positional deviation of registration patterns is reached, the controller 60 controls the pattern forming unit 60 to read pattern images from the ROM 602 where the registration patterns are stored in advance, and then to form the read registration patterns in two arrays along the sub-scanning direction on the image carrying surface of the intermediate transfer belt 11 so that each array contains the registration patterns K, Y, M, and Y (Step S901).

Next, the controller 60 obtains the waveforms output from the black toner density sensor 14*a* and the color toner density sensor 14*b* when the sensors detect the registration patterns of the respective colors (Step S902). The controller 60 then controls the correction amount calculating unit 609 to calculate the barycenter position of each of the main scanning registration detecting patterns K, Y, M, and C in each array (Step S903).

Then, the controller 60 controls the correction amount calculating unit 609 to correct the barycenter positions calculated based on the waveforms output from the color toner density sensor 14*b* for the main scanning registration detecting patterns Y, M, and C in a corresponding one of the arrays, wherein each barycenter position is corrected by using the amount of array deviation stored for the corresponding color in the array deviation storage unit 608 (Step S904). That is, the correction in this step is made in a manner that the calculated barycenter positions are closer by the amount of array deviation to the barycenter positions as calculated for the main scanning registration detecting pattern of the reference color (the color K) in the corresponding array.

Next, the controller 60 controls the correction amount calculating unit 608 to calculate the distance between the main scanning registration detecting pattern and the sub-scanning registration detecting pattern of the same color in the same array for each of K, Y, M, and C, and then calculates the positional deviation of each of the main scanning registration detecting patterns Y, M, and C with respect to the main scanning registration detecting pattern K by using the distance calculated for the registration patterns K as the reference (Step S905). Note that the distance between the main and sub-scanning registration detecting patterns of each color is calculated by using (i) the barycenter position as calculated based on the waveform output from the black toner density sensor 14*a* for the main scanning registration detection pattern of the corresponding color and (ii) the barycenter position as corrected in Step S904.

Then, the controller 60 stores the thus calculated amounts of positional deviation to the correction amount storage unit 610, so that the stored amounts of positional deviation are used to adjust the timings for image forming processes such as exposure timing (Step S906).

As has been described above, according to the present embodiment, the amounts of positional deviation of the respective registration patterns can be accurately calculated by using the black toner density sensor 14*a* and the color toner density sensor 14*b* mutually differing in the number of photodetectors. Here, the calculation accuracy is comparable to the case where the barycenter positions are calculated by using two color toner density sensors 14*b*. This is because the amounts of positional deviation are calculated after correcting the barycenter positions of each pair of registration patterns Y, M, and C as calculated by using the black toner density sensor 14*a* and the color toner density sensor 14*b*, so that the offset deviation (array deviation) occurring due to the configuration difference between the sensors has been offset.

Consequently, the present embodiment achieves to reduce the number of photodetectors as compared with the structure using two color toner density sensors 14*b*, which leads to the reduction in manufacturing cost.

(Modifications)

Up to this point, the present invention has been described by way of the embodiment. However, it should be appreciated that the present invention is not limited to the specific embodiment described above and various modifications including the following are possible without departing from the gist of the present invention.

(1) According to the above embodiment, the amount of array deviation is regarded to be equal among the colors Y, M, and C, and thus the barycenter position is corrected by the same amount of array deviation regardless of the color of the registration pattern. However, the amount of array deviation may differ among different colors depending on the wavelength of light used to irradiate the registration patterns. In view of the above, the different amounts of array deviation may be determined for the respective colors and correct the barycenter position of the registration patterns of each color by the amount of array deviation of the corresponding color.

Figure 10:
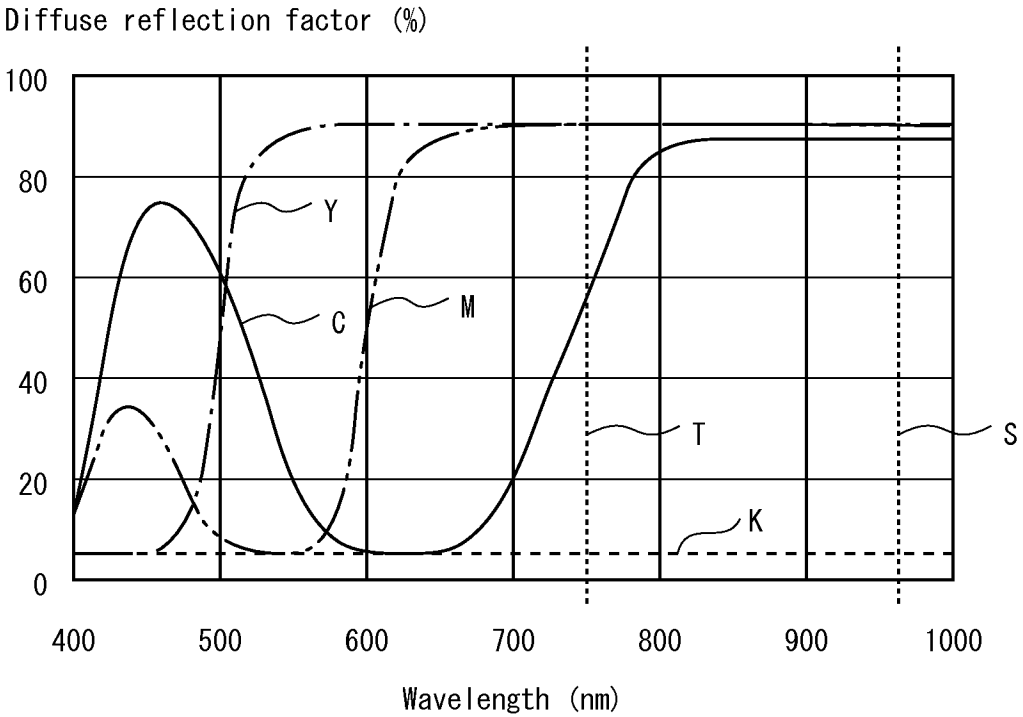
FIG. 10 is a graph showing the wavelength of irradiation light and the diffuse reflection factor for each of Y, M and C.
Figure 11A:
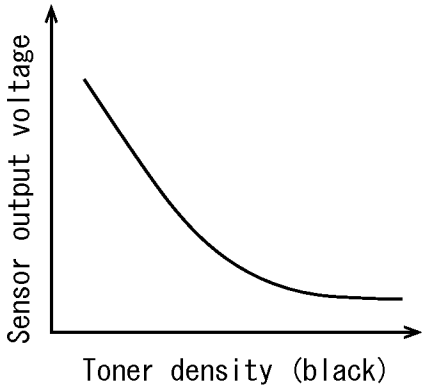
FIG. 11A shows an output characteristic curve plotted between the output voltage and the toner density of a K-color patch toner image measured by a reflection-type toner density sensor that detects regular reflection light.
Figure 11B:
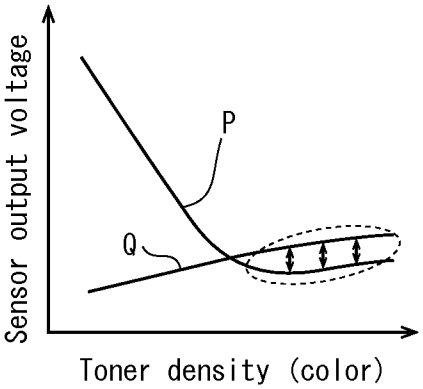
FIG. 11B shows an output characteristic curves each plotted between the output voltage and the toner density of a color patch toner image such as Y, M, or C measured by a reflection-type toner density sensor that detects regular reflection light and a reflection-type toner density sensor that detects diffused reflection light.
Figure 11C:
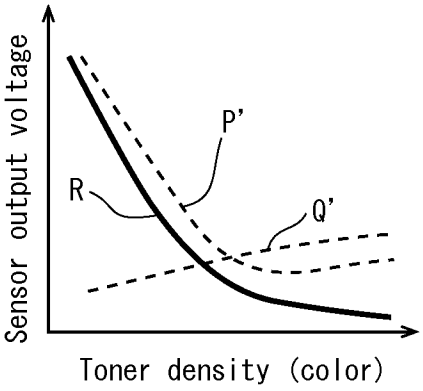
FIG. 11C shows output characteristic curves each plotted between the output voltage and the toner density of a color (i.e., Y, M, or C) patch toner image measured by (i) a reflection-type toner density sensor that detects the difference between regular reflection light and diffuse reflection light, (ii) a reflection-type toner density sensor that detects regular reflection light, and (iii) a reflection-type toner density sensor that detects diffuse reflection light.

FIG. 10 is a graph showing the wavelength of irradiation light and the diffuse reflection factor for each of Y, M and C. The reference signs K, Y, M, and C in the figure denote the plots for the colors K, Y, M, and C, respectively. As shown in the figure, when the wavelength of irradiation light is equal to 800 nm or longer, the diffuse reflection factors are almost equal among the colors Y, M, and C. However, when the wavelength of irradiation light is shorter than 800 nm, the diffuse reflection factors change differently among the colors Y, M, and C depending on the colors. As the diffuse reflection factor becomes lower, the influence of diffuse reflection light on the amount of array deviation becomes smaller. Therefore, the amount of array deviation becomes smaller.

As one example, suppose that the wavelength of irradiation light used is 940 nm (the wavelength denoted by the dotted line S in the figure). In this case, the diffuse reflection factors are substantially equal among the respective colors. Therefore, irrespective of the colors of registration patterns, it is not necessary to use a different amount of array deviation for the barycenter position correction. In another example, suppose that the wavelength of irradiation light used is 730 nm (the wavelength denoted by the dotted line T in the figure). In this case, while the diffuse reflection factor of each color of Y and M is about 95%, the diffuse reflection factor of the color C is about 43%, which is less than half the Y- or M-color diffuse reflection factor. Therefore, the amount of array deviation used to correct the barycenter position of a registration pattern C should be about 45% of the amount of array deviation used to correct the barycenter position of a registration pattern Y or M. By using different amounts of array deviation depending on the colors, it is made possible to more accurately calculate the amount of positional deviation occurring between the barycenter positions of the arrays Qa and Qb, as compared with the case where the same amount of array deviation is used for all colors.

As described above, when irradiation light resulting in the different diffuse reflection factors among the colors of Y, M, and C is used, the amounts of array deviation should be determined for the respective colors according to their diffuse reflection factors. By correcting the barycenter position of each registration pattern by the amount of array deviation determined for the corresponding color, the amount of deviation of the registration pattern is calculated more accurately.

(2) According to the above embodiment, the black toner density sensor 14*a* and the color toner density sensor 14*b* are disposed such that the relative positional relation among the LED element 141*a*, the photodetector 142*a*, and one of registration patterns in a pair (i.e., a pair of registration patterns of the same color disposed side by side in the main scanning direction) is identical to the relative positional relation among the LED element 141*b*, the photodetector 142*b*, and the other one of the registration patterns in the pair. However, in one modification, the respective toner density sensors may be disposed such that the relative positional relation of one sensor is different from the relative positional relation of the other sensor.

In this modification, the amounts of array deviation are determined in advance for each of a pair of sub-scanning registration detecting patterns and a pair of main scanning registration detecting patterns for the respective colors in a manner similar to the above embodiment. With this arrangement, by using the different toner density sensors 14*a* and 14*b*, the amount of deviation for each registration pattern can be calculated as accurately as the case where the barycenter positions of registration patterns are calculated by using two color toner density sensors 14*b*.

Yet, it is preferable to arrange the respective sensors to make the respective relative positional relations identical because the resulting amount of array deviation is smaller and thus the influence of the amount of array deviation is smaller. As a consequence, the calculation accuracy of the amount of positional deviation is further improved.

(3) According to the above embodiment, the color toner density sensor 14*b* is arranged so that that the detection positions of the photodetectors 142*b* and 143*b* are aligned along the main scanning direction (the direction perpendicular to the rotation direction of the image carrying surface). In one modification, however, the direction along which the respective detection positions are aligned may be different from the main scanning direction.

In this modification, the amounts of array deviation are determined in advance for each of a pair of sub-scanning registration detecting patterns and a pair of main scanning registration detecting patterns for the respective colors in a manner similar to the above embodiment. With this arrangement, by using the different toner density sensors 14*a* and 14*b*, the amount of deviation for each registration pattern can be calculated as accurately as the case where the barycenter positions of registration patterns are calculated by using two color toner density sensors 14*b*.

Yet, it is preferable to arrange the color toner density sensor 14*b* to have the detection positions aligned along the main scanning direction because the resulting amount of array deviation for sub-scanning registration detecting patterns is made equal to zero and thus the influence of the amount of array deviation is eliminated. As a consequence, the calculation accuracy of the amount of positional deviation for a sub-scanning registration detecting pattern of each color is further improved.

(4) According to the above embodiment, the barycenter position correction is applied to only one of the two arrays (array Qb in FIG. 3) each including main scanning registration detecting patterns arranged in the sub-scanning direction. With the barycenter position correction, the black toner density sensor 14*a* and the color density sensor 14*b* differing in the number of photodetectors are used to detect the respective barycenter positions of the main scanning registration detecting patterns included in the respective arrays in a manner to offset the array deviation (i.e., offset deviation) that occurs due to the configuration difference between the respective sensors. However, the way to offset the array deviation is not limited to the one described above.

That is, as long as the amount of positional deviation between the respective barycenter positions as calculated for the two main scanning registration detecting patterns in a pair is reduced by the corresponding amount of array deviation, any other way of correction is applicable.

For example, the positional deviation may be offset by correcting only the other one of arrays of main scanning registration detecting patterns (the array Qa in FIG. 3). More specifically, the correction may be made by adding the amount of array deviation X to each of the barycenter positions Yaa, Maa, and Caa calculated for the main scanning registration detecting patterns Y, M, and C that are included in the array Qa, rather than by subtracting the amount of array deviation X from each of the barycenter positions Ybb, Mbb, and Cbb calculated for the main scanning registration detecting patterns Y, M, and C that are included in the array Qb.

In another modification, the correction may be applied to both the main scanning registration detecting patterns in the respective arrays in the following manner rater than by simply subtracting the amount of array deviation X from each of the barycenter positions Ybb, Mbb, and Cbb respectively calculated for the main scanning registration detecting patterns Y, M, and C that are included in the array Qb. That is, the barycenter position calculated for each of the main scanning registration detecting patterns Y, M, and C in the array Qa is corrected by adding a half of the amount of array deviation (X/2), whereas the barycenter position calculated for each of the main scanning registration detecting patterns Y, M, and C in the array Qb is corrected by subtracting a half of the amount of array deviation (X/2).

(5) According to the above embodiment, the description is directed to the case where the intermediate transfer belt 11 acts as the image carrier and thus the registration pattern is formed on the surface of the intermediate transfer belt 11. However, this is only an example and without limitation. The calculation method of the positional deviation of a registration pattern according to the above embodiment is similarly applicable in the case where the registration pattern is formed on the photosensitive drum(s).

<Recapitulation>

The image forming apparatus described above according to one embodiment of the present invention calculates an amount of positional deviation for each of a plurality of colors by: forming registration patterns in two arrays along a sub-scanning direction on an image carrying surface of an image carrier by a plurality of image creation units that are configured to create toner images in the respective colors, each array including for each color a registration pattern for detecting a positional deviation in the main scanning direction and a different registration pattern for detecting a positional deviation in the sub-scanning direction, each registration pattern in one of the arrays being paired with an identical registration pattern in the other array, the two arrays being arranged such that the registration patterns in each pair are side by side along the main scanning direction; irradiating each pair of registration patterns with light; and detecting light reflected from each pair of registration patterns. Further, the image forming apparatus includes a first toner density sensor, a second toner density sensor, a calculating unit, and a storage unit. The first toner density sensor includes: a light-emitting element configured to emit light to irradiate one of the registration patterns in each pair; a regular reflection photodetector configured to detect regular reflection light from the one registration pattern in the pair; and a diffuse reflection photodetector configured to detect diffuse reflection light from the one registration pattern in the pair. In addition, the first toner density sensor is configured to output a difference between detection signals of the reflection light detected by the respective photodetectors. The second toner density sensor includes: a light-emitting element configured to emit light to irradiate the other one of the registration patterns in the pair; and a single photo detector that is a regular reflection photodetector configured to detect regular reflection light from the other registration pattern in the pair. In addition, the second toner density sensor is configured to output a detection signal of the regular reflection light detected by the regular reflection photodetector. The calculating unit is configured to calculate: a position of the one of the registration patterns in the pair by using the difference between the respective detection signals output by the first toner density sensor; a position of the other registration pattern in the pair by using the detection signal of the regular reflection light output by the second toner density sensor; and a positional deviation for each registration pattern in the pair based on the respective positions calculated. The storage unit stores an index value indicating an amount of offset deviation estimated to occur between respective positions calculated for the registration patterns in the pair based on the respective detection signals output by the first toner density sensor and the second toner density sensor when the registration patterns in the pair are formed without any positional deviation. The calculating unit corrects a relative positional relation between the respective positions calculated for the registration patterns in the pair in a manner that an amount of positional deviation between the respective positions is reduced by the index value.

Here, the first toner density sensor may be additionally used in image stabilization control to detect a toner density of a patch toner image formed in a color other than black on the image carrying surface.

Here, the second toner density sensor may be additionally used in image stabilization control to detect a toner density of a patch toner image formed in black on the image carrying surface.

With the above configuration, the two toner density sensors differing in the number of photodetectors are used and the positions of a pair of registration patterns as calculated are corrected so as to offset the amount of offset deviation that occurs due to the configuration difference. Subsequently, the amount of positional deviation is calculated by using the positions of the respective registration pattern as corrected. Therefore, even in the case of using the two toner density sensors of the different configuration, the amounts of positional deviation can be calculated accurately to the level comparable to that calculated with the use of two toner density sensors of the same configuration.

That is, the above configuration allows the number of photodetectors to be reduced and hence the manufacturing cost to be reduced without compromising the calculation accuracy of the positional deviation, as compared with a configuration including two first toner density sensors each capable of outputting a detection signal corresponding to the difference between regular reflection light components and diffuse reflection light components and thus capable of accurate measurement of color toner densities.

Here, the first toner density sensor may be identical to the second toner density sensor with respect to a relative positional relation among the light-emitting element, the regular reflection photodetector, and a corresponding one of the two arrays of the registration pattern.

With the above configuration, the two toner density sensors differing in configuration are arranged to be identical with respect to the relative positional relation among the light-emitting element, the photodetector for detecting regular reflection light, and the registration pattern to be detected. This ensures to avoid the offset deviation that occurs due to the difference in the respective relative positional relations. That is the resulting amount of offset deviation is reduced by the corresponding amount. Therefore, this configuration further improves the calculation accuracy of the amount of positional deviation for each registration pattern.

Further, the regular reflection photodetector and the diffuse reflection photodetector in the first reflection toner density sensor may be arranged so that positions on the image carrying surface detectable by the respective photodetectors are aligned in the main scanning direction. Each registration pattern for detecting a positional deviation in the main scanning direction may be a linear pattern extending nonparallel to the main scanning direction, and each registration pattern for detecting a positional deviation in the sub-scanning direction may be a linear pattern extending parallel to the main scanning direction.

Still further, the storage unit may store: an index value indicating an amount of offset deviation estimated for a pair of registration patterns for detecting a positional deviation in the main scanning direction; and an index value indicating an amount of offset deviation estimated for a pair of registration patterns for detecting a positional deviation in the sub-scanning direction. The index value indicating the amount of offset deviation estimated for the pair of registration patterns for detecting a positional deviation in the sub-scanning direction may be equal to zero.

With the above configuration, the direction along which the detection positions of the photodetector for regular reflection light and the photodetector for detecting diffuse reflection light are aligned matches the main scanning direction, and the direction along which the linear pattern extends also matches the main scanning direction. Therefore, regular reflection light and diffuse reflection light from the registration pattern are received by the respective photodetectors substantially simultaneously without a time lag. As a consequence, the respective sensors detect a pair of linear patterns for detecting a positional deviation in the sub-scanning direction substantially simultaneously without a time lag. Therefore, the amount of offset deviation of each sub-scanning registration detecting pattern is made negligible. Therefore, this configuration further improves the calculation accuracy of the amount of positional deviation for each registration pattern for detecting a positional deviation in the sub-scanning direction.

Still further, the respective colors of toner images created by the image creation units may include colors that differ in a diffuse reflection factor. The amount of offset deviation estimated for each pair of registration patterns may differ according to the diffuse reflection factor of the corresponding color. The storage unit may store a plurality of index values each indicating the amount of offset deviation estimated according to the diffuse reflection factor of the corresponding color. The calculating unit may correct the relative positional relation between the respective positions calculated for the registration patterns in the pair in a manner that the amount of positional deviation is reduced by the index value stored for the corresponding color.

Still further, the index values stored in the storage unit may include an index value for the registration patterns in a black color and index values for the respective registration patterns in colors other than black. The index value stored for black may be equal to zero, and the index values stored for colors other than black are all equal to each other and other than zero.

As above, the respective colors of toner images created by the image creation units include colors that differ in a diffuse reflection factor, and the amount of offset deviation estimated for each pair of registration patterns differs according to the diffuse reflection factor of the corresponding color. In this case, the relative positional relation between the respective positions calculated for the registration patterns in the pair are corrected by using the amount of offset deviation indicated by the index value stored for the corresponding color. Consequently, the amount of positional deviation for each registration pattern is calculated accurately, even if the amount of offset deviation differs depending on the diffuse reflection factor of the corresponding color.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus that calculates an amount of positional deviation for each of a plurality of colors by:

forming registration patterns in two arrays along a sub-scanning direction on an image carrying surface of an image carrier by a plurality of image creation units that are configured to create toner images in the respective colors, each array including for each color a registration pattern for detecting a positional deviation in the main scanning direction and a different registration pattern for detecting a positional deviation in the sub-scanning direction, each registration pattern in one of the arrays being paired with an identical registration pattern in the other array, the two arrays being arranged such that the registration patterns in each pair are side by side along the main scanning direction;

irradiating each pair of registration patterns with light; and detecting light reflected from each pair of registration patterns, the image forming apparatus comprising:

a first toner density sensor including: a light-emitting element configured to emit light to irradiate one of the registration patterns in each pair; a regular reflection photodetector configured to detect regular reflection light from the one registration pattern in the pair; and a diffuse reflection photodetector configured to detect diffuse reflection light from the one registration pattern in the pair, the first toner density sensor being configured to output a difference between detection signals of the reflection light detected by the respective photodetectors;

a second toner density sensor including: a light-emitting element configured to emit light to irradiate the other one of the registration patterns in the pair; and a single photo detector that is a regular reflection photodetector configured to detect regular reflection light from the other registration pattern in the pair, the second toner density sensor being configured to output a detection signal of the regular reflection light detected by the regular reflection photodetector;

a calculating unit configured to calculate:

a position of the one of the registration patterns in the pair by using the difference between the respective detection signals output by the first toner density sensor;

a position of the other registration pattern in the pair by using the detection signal of the regular reflection light output by the second toner density sensor; and a positional deviation for each registration pattern in the pair based on the respective positions calculated; and a storage unit that stores an index value indicating an amount of offset deviation estimated to occur between respective positions calculated for the registration patterns in the pair based on the respective detection signals output by the first toner density sensor and the second toner density sensor when the registration patterns in the pair are formed without any positional deviation, wherein the calculating unit corrects a relative positional relation between the respective positions calculated for the registration patterns in the pair in a manner that an amount of positional deviation between the respective positions is reduced by the index value.

2. The image forming apparatus according to claim 1, wherein the first toner density sensor is identical to the second toner density sensor with respect to a relative positional relation among the light-emitting element, the regular reflection photodetector, and a corresponding one of the two arrays of the registration pattern.

3. The image forming apparatus according to claim 2, wherein the regular reflection photodetector and the diffuse reflection photodetector in the first reflection toner density sensor are arranged so that positions on the image carrying surface detectable by the respective photodetectors are aligned in the main scanning direction, and each registration pattern for detecting a positional deviation in the main scanning direction is a linear pattern extending nonparallel to the main scanning direction, and each registration pattern for detecting a positional deviation in the sub-scanning direction is a linear pattern extending parallel to the main scanning direction.

4. The image forming apparatus according to claim 3, wherein the storage unit stores:

an index value indicating an amount of offset deviation estimated for a pair of registration patterns for detecting a positional deviation in the main scanning direction; and an index value indicating an amount of offset deviation estimated for a pair of registration patterns for detecting a positional deviation in the sub-scanning direction, and the index value indicating the amount of offset deviation estimated for the pair of registration patterns for detecting a positional deviation in the sub-scanning direction is equal to zero.

5. The image forming apparatus according to claim 1, wherein the respective colors of toner images created by the image creation units include colors that differ in a diffuse reflection factor, the amount of offset deviation estimated for each pair of registration patterns differs according to the diffuse reflection factor of the corresponding color, and the storage unit stores a plurality of index values each indicating the amount of offset deviation estimated according to the diffuse reflection factor of the corresponding color, and the calculating unit corrects the relative positional relation between the respective positions calculated for the registration patterns in the pair in a manner that the amount of positional deviation is reduced by the index value stored for the corresponding color.

6. The image forming apparatus according to claim 5, wherein the index values stored in the storage unit include an index value for the registration patterns in a black color and index values for the respective registration patterns in colors other than black, and the index value stored for black is equal to zero, and the index values stored for colors other than black are all equal to each other and other than zero.

7. The image forming apparatus according to claim 1, wherein the first toner density sensor is additionally used in image stabilization control to detect a toner density of a patch toner image formed in a color other than black on the image carrying surface.

8. The image forming apparatus according to claim 1, wherein the second toner density sensor is additionally used in image stabilization control to detect a toner density of a patch toner image formed in black on the image carrying surface.

* * * * *